US009998837B2

(12) United States Patent
Andersson

(10) Patent No.: US 9,998,837 B2
(45) Date of Patent: Jun. 12, 2018

(54) PERCUTANEOUS VIBRATION CONDUCTOR

(71) Applicant: Cochlear Limited, Macquarie University, NSW (AU)

(72) Inventor: Marcus Andersson, Göteborg (SE)

(73) Assignee: Cochlear Limited, Macquarie University, NSW (AU)

( * ) Notice: Subject to any disclaimer, the term of this patent is extended or adjusted under 35 U.S.C. 154(b) by 569 days.

(21) Appl. No.: 14/549,053

(22) Filed: Nov. 20, 2014

(65) Prior Publication Data

US 2015/0312687 A1 Oct. 29, 2015

Related U.S. Application Data

(60) Provisional application No. 61/985,755, filed on Apr. 29, 2014.

(51) Int. Cl.
*H04R 25/00* (2006.01)

(52) U.S. Cl.
CPC ..... *H04R 25/606* (2013.01); *H04R 2225/63* (2013.01); *H04R 2460/13* (2013.01)

(58) Field of Classification Search
CPC ..... H04R 25/00–25/75; H04R 2225/00–2225/83; H04R 2460/13
See application file for complete search history.

(56) References Cited

U.S. PATENT DOCUMENTS 3,995,644 A * 12/1976 Parsons ..... A61N 1/05 439/827
4,419,995 A 12/1983 Hochmair et al.
4,498,461 A 2/1985 Hakansson
4,606,329 A 8/1986 Hough
4,612,915 A 9/1986 Hough et al.
4,791,673 A 12/1988 Schreiber
5,015,225 A 5/1991 Hough et al.
5,430,801 A 7/1995 Hill
5,507,303 A * 4/1996 Kuzma ..... A61N 1/05 128/899
5,735,790 A 4/1998 Hakansson et al.
6,589,244 B1 7/2003 Sevrain et al.
6,643,378 B2 11/2003 Schumaier
(Continued)

FOREIGN PATENT DOCUMENTS

JP 2007184722 A 7/2007
WO 01/93645 A1 12/2001
(Continued)

OTHER PUBLICATIONS

International Search Report for PCT/IB2015/053095, dated Jul. 28, 2015.
(Continued)

*Primary Examiner* — Thaddeus Cox
(74) *Attorney, Agent, or Firm* — Martin J. Cosenza; Pilloff & Passino LLP

(57) ABSTRACT

A device, comprising a prosthesis including an external component configured to output a signal in response to an external stimulus and a skin penetrating component configured to communicatively transfer the signal at least partially beneath skin of the recipient, wherein the skin penetrating component is configured to extend into skin of the recipient and substantially lay above a surface of bone of a recipient in abutting contact thereto.

39 Claims, 30 Drawing Sheets

(56) References Cited

U.S. PATENT DOCUMENTS

| | | | | |
|---|---|---|---|---|
| 6,786,860 | B2 | 9/2004 | Maltan et al. | |
| 7,021,676 | B2 | 4/2006 | Westerkull | |
| 7,033,313 | B2 | 4/2006 | Lupin et al. | |
| 7,058,192 | B2 | 6/2006 | Müller et al. | |
| 7,127,078 | B2 | 10/2006 | Mann et al. | |
| 7,266,208 | B2 | 9/2007 | Charvin et al. | |
| 7,266,209 | B1 | 9/2007 | House | |
| 7,386,143 | B2 | 6/2008 | Easter et al. | |
| 8,170,253 | B1 | 5/2012 | Lynch et al. | |
| 2003/0063764 | A1 | 4/2003 | Maltan et al. | |
| 2004/0210103 | A1 | 10/2004 | Westerkull | |
| 2005/0249366 | A1* | 11/2005 | Westerkull | H04R 25/606 381/151 |
| 2006/0050913 | A1 | 3/2006 | Westerkull | |
| 2006/0056649 | A1 | 3/2006 | Schumaier | |
| 2008/0139874 | A1 | 6/2008 | Slattery et al. | |
| 2008/0255406 | A1 | 10/2008 | Ball et al. | |
| 2009/0023109 | A1* | 1/2009 | Jinton | A61C 8/0025 433/174 |
| 2009/0043149 | A1* | 2/2009 | Abel | H04R 17/02 600/25 |
| 2010/0087700 | A1 | 4/2010 | Zimmerling | |
| 2012/0083860 | A1* | 4/2012 | Hakansson | H04R 1/288 607/57 |
| 2012/0203318 | A1* | 8/2012 | Mann | A61M 39/0247 607/116 |
| 2012/0215056 | A1 | 8/2012 | Hillbratt et al. | |
| 2013/0041206 | A1* | 2/2013 | Andersson | A61M 39/0247 600/25 |
| 2013/0090518 | A1* | 4/2013 | Bjorn | H04R 25/606 600/25 |
| 2013/0114834 | A1 | 5/2013 | Bern | |
| 2013/0345496 | A1 | 12/2013 | Parker | |
| 2014/0193011 | A1 | 7/2014 | Parker | |

FOREIGN PATENT DOCUMENTS

| | | | |
|---|---|---|---|
| WO | 2004/093401 | A1 | 10/2004 |
| WO | 2005/000391 | A1 | 1/2005 |
| WO | 2005037153 | A1 | 4/2005 |
| WO | 2010111547 | A1 | 9/2010 |

OTHER PUBLICATIONS

Partial Supplementary Search Report for EP Patent No. 3 138 302, dated Oct. 16, 2017.

* cited by examiner

PERCUTANEOUS VIBRATION CONDUCTOR

CROSS-REFERENCE TO RELATED APPLICATIONS

This application claims priority to Provisional U.S. Patent Application No. 61/985,755, entitled PERCUTANEOUS VIBRATION CONDUCTOR, filed on Apr. 29, 2014, naming Marcus ANDERSSON of Molnlycke, Sweden, as an inventor, the entire contents of that application being incorporated herein by reference in its entirety.

BACKGROUND

Hearing loss, which may be due to many different causes, is generally of two types: conductive and sensorineural. Sensorineural hearing loss is due to the absence or destruction of the hair cells in the cochlea that transduce sound signals into nerve impulses. Various hearing prostheses are commercially available to provide individuals suffering from sensorineural hearing loss with the ability to perceive sound. For example, cochlear implants use an electrode array implanted in the cochlea of a recipient to bypass the mechanisms of the ear. More specifically, an electrical stimulus is provided via the electrode array to the auditory nerve, thereby causing a hearing percept.

Conductive hearing loss occurs when the normal mechanical pathways that provide sound to hair cells in the cochlea are impeded, for example, by damage to the ossicular chain or ear canal. Individuals suffering from conductive hearing loss may retain some form of residual hearing because the hair cells in the cochlea may remain undamaged.

Individuals suffering from conductive hearing loss typically receive an acoustic hearing aid. Hearing aids rely on principles of air conduction to transmit acoustic signals to the cochlea. In particular, a hearing aid typically uses a component positioned in the recipient's ear canal or on the outer ear to amplify a sound received by the outer ear of the recipient. This amplified sound reaches the cochlea causing motion of the perilymph and stimulation of the auditory nerve.

In contrast to hearing aids, certain types of hearing prostheses commonly referred to as bone conduction devices, convert a received sound into mechanical vibrations. The vibrations are transferred through the skull to the cochlea causing generation of nerve impulses, which result in the perception of the received sound. Bone conduction devices may be a suitable alternative for individuals who cannot derive sufficient benefit from acoustic hearing aids.

SUMMARY

In an exemplary embodiment, there is a device, comprising a prosthesis including an external component configured to output a signal in response to an external stimulus and a skin penetrating component configured to communicatively transfer the signal at least partially beneath skin of the recipient, wherein the skin penetrating component is configured to extend into skin of the recipient and substantially entirely lay above a surface of bone of a recipient in abutting contact thereto.

In another exemplary embodiment, there is a device comprising a bone conduction hearing prosthesis including an external component configured to output vibrations in response to a captured sound and a skin penetrating component abutting the external component configured to transfer the vibrations at least partially beneath the skin of the recipient, wherein the skin penetrating component is at least substantially supported by soft tissue.

In another exemplary embodiment, there is a device comprising a bone conduction hearing prosthesis including an external component configured to output vibrations in response to a captured sound and a skin penetrating component configured to abut the external component such that it is in vibrational communication with the external component, wherein the skin penetrating component is a skin anchored skin penetrating component.

In another exemplary embodiment, there is a method comprising placing a hole through skin of a recipient above a bone of the recipient, inserting a skin penetrating component into the hole such that it extends underneath the skin of the recipient and extends through the skin of the recipient, and transferring vibrations into the bone via the skin penetrating component, thereby evoking a hearing percept.

In another exemplary embodiment, there is a device comprising means for conducting vibrations generated externally to a recipient to a location beneath a surface of skin of the recipient, wherein the means for conducting vibrations includes means for anchoring the means for conducting vibrations in the recipient.

BRIEF DESCRIPTION OF THE DRAWINGS

Embodiments of the present invention are described below with reference to the attached drawings, in which.

DETAILED DESCRIPTION

Figure 1:
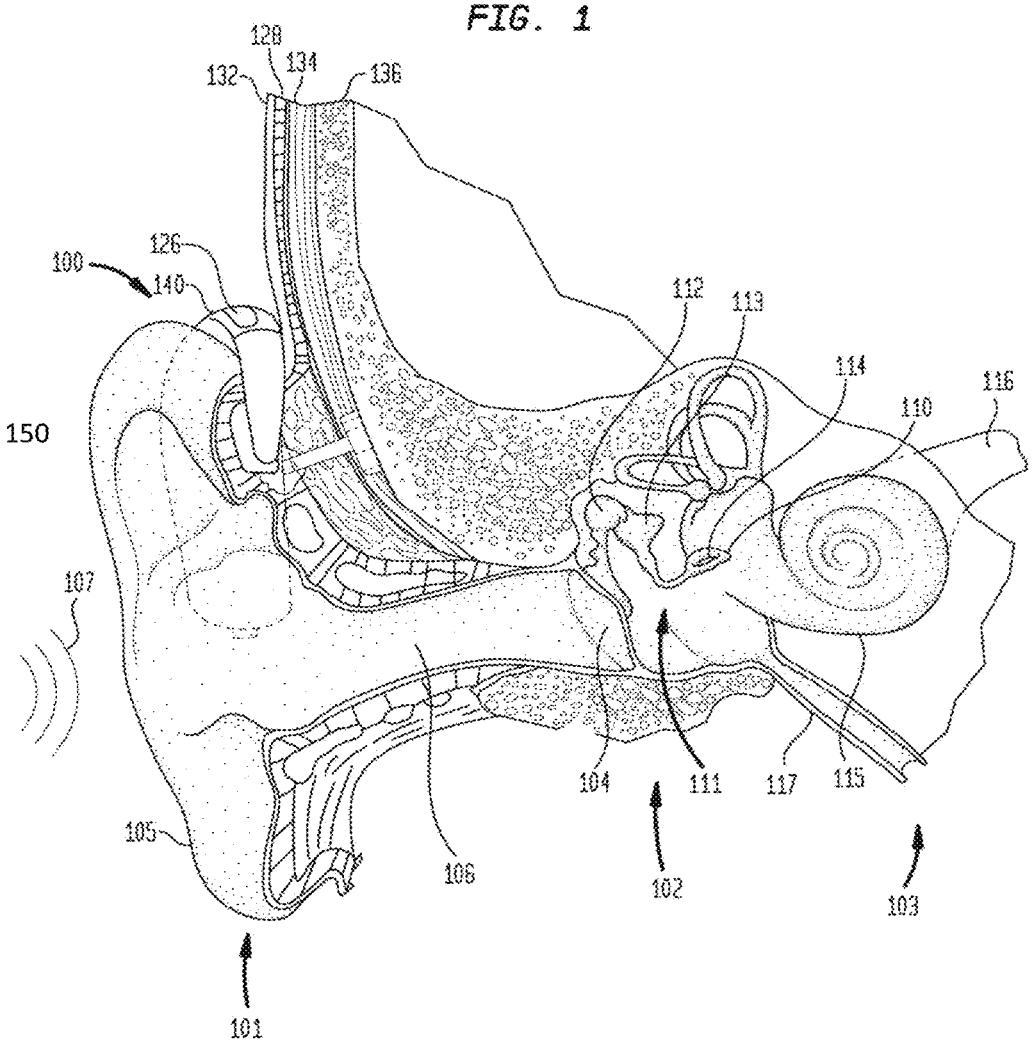
FIG. 1 is a perspective view of an exemplary bone conduction device in which embodiments of the present invention may be implemented.

FIG. 1 is a perspective view of a bone conduction device 100 in which embodiments of the present invention may be implemented, worn by a recipient. As shown, the recipient has an outer ear 101, a middle ear 102 and an inner ear 103.

Elements of outer ear 101, middle ear 102 and inner ear 103 are described below, followed by a description of bone conduction device 100.

In a fully functional human hearing anatomy, outer ear 101 comprises an auricle 105 and an ear canal 106. A sound wave or acoustic pressure 107 is collected by auricle 105 and channeled into and through ear canal 106. Disposed across the distal end of ear canal 106 is a tympanic membrane 104 which vibrates in response to acoustic wave 107. This vibration is coupled to oval window or fenestra ovalis 110 through three bones of middle ear 102, collectively referred to as the ossicles 111 and comprising the malleus 112, the incus 113 and the stapes 114. The ossicles 111 of middle ear 102 serve to filter and amplify acoustic wave 107, causing oval window 110 to vibrate. Such vibration sets up waves of fluid motion within cochlea 139. Such fluid motion, in turn, activates hair cells (not shown) that line the inside of cochlea 139. Activation of the hair cells causes appropriate nerve impulses to be transferred through the spiral ganglion cells and auditory nerve 116 to the brain (not shown), where they are perceived as sound.

FIG. 1 also illustrates the positioning of conduction device 100 relative to outer ear 101, middle ear 102 and inner ear 103 of a recipient of device 100. As shown, bone conduction device 100 is positioned behind outer ear 101 of the recipient. Bone conduction device 100 comprises an external component 140 in the form of a behind-the-ear (BTE) device, and an implantable component 150 in the form of a percutaneous vibration conductor, both of which are described in greater detail below.

External component 140 typically comprises one or more sound input elements 126, such as a microphone, for detecting and capturing sound, a sound processing unit (not shown) and a power source (not shown). The external component 140 includes an actuator (not shown), which in the embodiment of FIG. 1, is located within the body of the BTE device, although in other embodiments, the actuator may be located remote from the BTE device (or other component of the external component 140 having a sound input element, a sound processing unit and/or a power source, etc.).

It is noted that sound input element 126 may comprise, for example, devices other than a microphone, such as, for example, a telecoil, etc. In an exemplary embodiment, sound input element 126 may be located remote from the BTE device and may take the form of a microphone or the like located on a cable or may take the form of a tube extending from the BTE device, etc. Alternatively, sound input element 126 may be subcutaneously implanted in the recipient, or positioned in the recipient's ear. Sound input element 126 may also be a component that receives an electronic signal indicative of sound, such as, for example, from an external audio device. For example, sound input element 126 may receive a sound signal in the form of an electrical signal from an MP3 player electronically connected to sound input element 126.

The sound processing unit of the external component 140 processes the output of the sound input element 126, which is typically in the form of an electrical signal. The processing unit generates control signals that cause the actuator to vibrate. In other words, the actuator converts the electrical signals into mechanical vibrations for delivery to the recipient's skull.

In the embodiment of FIG. 1, implantable component 150, which in the present embodiment is a percutaneous vibration conductor 150, can be seen extending from a location abutting the BTE device, through the skin 132, fat 128 and muscle 134 to be in substantial abutting contact with the bone 136 (although in alternate embodiments, the percutaneous vibration conductor 150 does not abut bone 136, as will be detailed below). It is noted by the phrase "abutting contact," this distinguishes from a traditional bone fixture that extends into the bone of the recipient, at least before osseiontegration occurs. That said, the term "substantial" qualifies this to include the use of a screw or other bone penetrating component is detailed herein, which differ from traditional bone fixtures in that the bone penetrating components are not utilized to hold/carry the weight of an external component of a hearing prosthesis and/or a vibration generating component. Conversely, "complete abutting contact" means that there is no bone surface penetrating component (or bone penetrating component, at least not prior to osseointegratoin).

Accordingly, in at least some embodiments, the skin penetrating component when implanted in a recipient is not rigidly attached to bone of the recipient.

Briefly, and as will be expanded upon below, the combination of the external component 140 and the percutaneous vibration conductor 150 correspond to a device that comprises a prosthesis including an external component configured to output a signal in response to an external stimulus and a skin penetrating component configured to communicatively transfer the signal at least partially beneath the skin of the recipient. In this exemplary embodiment, the skin penetrating component (e.g., the percutaneous vibration conductor 150) is configured to extend into skin of the recipient and substantially entirely lay above a surface of bone of a recipient in abutting contact thereto. In some embodiments, no part of the percutaneous vibration conductor 150 extends below a local surface of the bone. With respect to exemplary embodiments initially described, the signals are vibrations generated by the BTE device that are transferred to the percutaneous vibration conductor 150.

In the exemplary embodiment depicted in FIG. 1, vibrations generated by the BTE device 140 are conducted directly into the percutaneous vibration conductor 150 (e.g., because the percutaneous vibration conductor 150 directly abuts the BTE device, as can be seen), which in turn conducts those vibrations to bone 136. That is, vibrations generated by the actuator are transferred from the actuator of the BTE device, through the skin from the BTE device (directly from the actuator and/or through a housing of the BTE device), through the skin of the recipient, and into the bone of the recipient, thereby evoking a hearing percept. In an exemplary embodiment, the percutaneous vibration conductor does not bear any load (e.g., weight, torque) or at least any meaningful load, with respect to supporting the BTE device, at least with respect to supporting the BTE device against the pull of gravity and/or head movement, also as will be detailed below. Accordingly, in an exemplary embodiment, the percutaneous vibration conductor 150 is non-supportedly coupled to the BTE device 240.

Figure 2A:
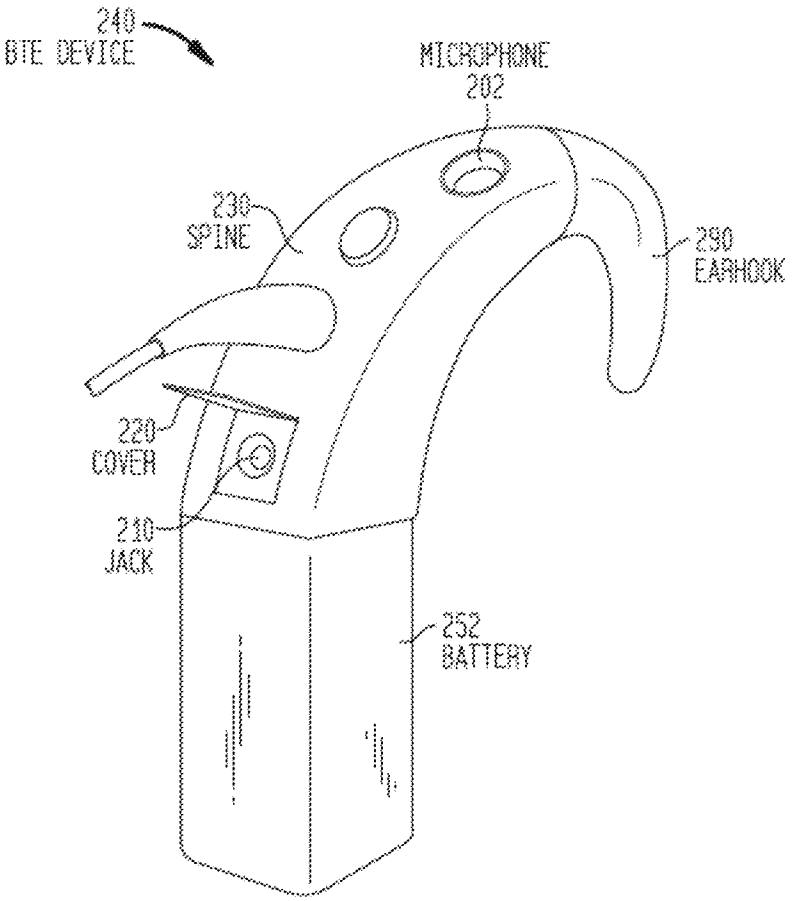
FIG. 2A is a perspective view of a Behind-The-Ear (BTE) device according to an exemplary embodiment.

Accordingly, in an exemplary embodiment, there is an operationally removable component (e.g., BTE device) that includes a vibrator that is in vibrational communication with the percutaneous vibration conductor 150 such that vibrations generated by the vibrator in response to a sound captured by sound capture device 126 are transmitted to the percutaneous vibration conductor 150 and from the conductor 150 to bone (either directly or through soft tissue as will be described in greater detail below) in a manner that at least effectively evokes hearing percept. By "effectively evokes a hearing percept," it is meant that the vibrations are such that a typical human between 18 years old and 40 years old having a fully functioning cochlea receiving such vibrations, where the vibrations communicate speech, would be able to understand the speech communicated by those vibrations in a manner sufficient to carry on a conversation provided that those humans are fluent in the language forming the basis of the speech. In an exemplary embodiment, the vibrational communication effectively evokes a hearing percept, if not a functionally utilitarian hearing percept. FIG. 2A is a perspective view of a BTE device 240 of a hearing prosthesis, which, in this exemplary embodiment, corresponds to the BTE device (external component 140) detailed above with respect to FIG. 1. BTE device 240 includes one or more microphones 202, and may further include an audio signal jack 210 under a cover 220 on the spine 230 of BTE device 240. It is noted that in some other embodiments, one or both of these components (microphone 202 and/or jack 210) may be located on other positions of the BTE device 240, such as, for example, the side of the spine 230 (as opposed to the back of the spine 230, as depicted in FIG. 2), the ear hook 290, etc. FIG. 2A further depicts battery 252 and ear hook 290 removably attached to spine 230.

It is noted that while embodiments described herein will be described in terms of utilizing a BTE device as the external component, in alternate embodiments, other devices are utilized as the external component. For example, a button sound processor configured to vibrate according to the external component(s) detailed herein, a hair clip external component configured to vibrate according to the external component(s) detailed herein, a skin clip external component configured to vibrate according to the external component(s) detailed herein, a clothes clip external component configured to vibrate according to the external component(s) detailed herein, a pair of reading glasses (with real lenses or cosmetic (fake lenses)) configured to vibrate according to the external component(s) detailed herein, or other type of external bone conduction sound processor can be utilized as the external component. Any device that is usable with the conductors detailed herein can be utilized in at least some embodiments provided that the teachings detailed herein are enabled for use in a bone conduction device to evoke a hearing percept.

Figure 2B:
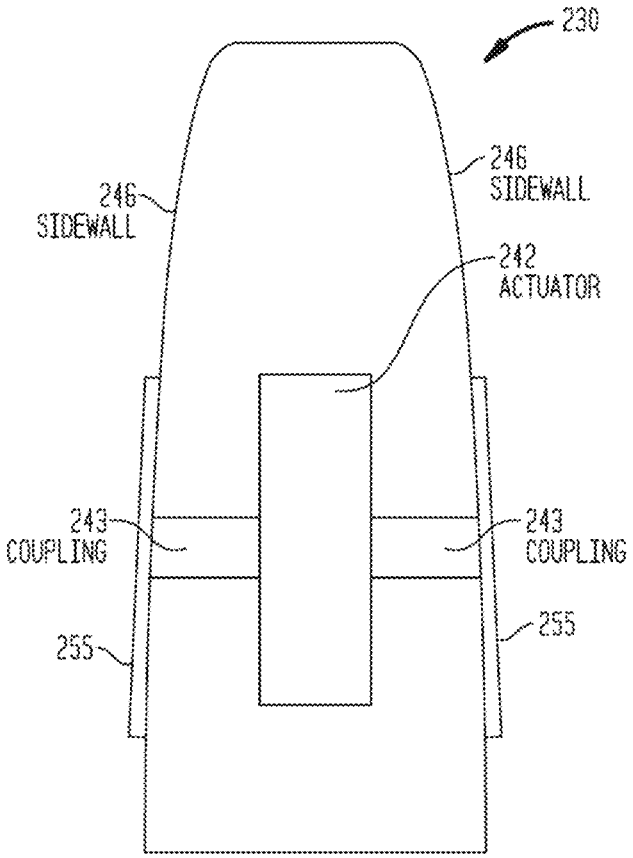
FIG. 2B is a cross-sectional view of a spine of the BTE device of FIG. 2A.
Figure 2C:
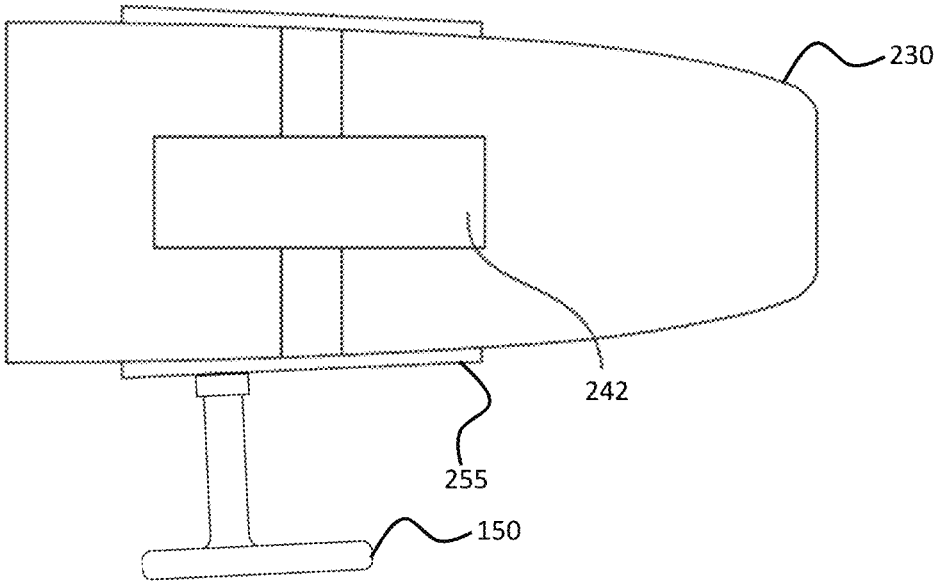
FIG. 2C depicts the portion of the BTE device depicted in FIG. 2B in contact with an exemplary percutaneous vibration conductor 150.

FIG. 2B is a cross-sectional view of the spine 230 of BTE device 240 of FIG. 2A. Actuator 242 is shown located within the spine 230 of BTE device 242. Actuator 242 is a vibrator actuator, and is coupled to the sidewalls 246 of the spine 230 via couplings 243 which are configured to transfer vibrations generated by actuator 242 to the sidewalls 246, from which those vibrations are transferred to the percutaneous vibration conductor 150 (or to skin of a recipient in embodiments where a transcutaneous bone conduction device BTE device is utilized, where the transcutaneous bone conduction device BTE device is utilized for percutaneous use by placing the BTE device in abutting contact with the percutaneous vibration conductor 150. In an exemplary embodiment, couplings 243 are rigid structures having utilitarian vibrational transfer characteristics. The sidewalls 246 form at least part of a housing of spine 230. In some embodiments, the housing seals the interior of the spine 230 from the external environment.

FIG. 2B also depicts a vibration transfer surface located on the sidewalls 246 of the BTE device 240. In at least some embodiments, vibration transfer surface 255 can be any surface that is configured to enable the teachings detailed herein and/or variations thereof to be practiced with respect to transferring vibrations from the BTE device 240 to the percutaneous vibration conductor 150, which can contact the BTE device 240 in the manner exemplarily depicted in FIG. 2C, where a shaft of the vibration transfer conductor 150 (i.e., the portion that extends outward away from the recipient towards the BTE device) is depicted abutting the vibration transfer surface 255 (which also means that the vibration transfer surface 255 is abutting the vibration transfer conductor 150). Additional details of some exemplary embodiments of some vibration transfer conductors 150 are described below.

In an exemplary embodiment, vibration transfer surface 255 can be the sidewall 246 of the spine 230. Alternatively, vibration transfer surface 255 can be a different component configured to enhance the transfer of vibrations from the spine 230 to the percutaneous vibration conductor 150. By way of example only and not by way of limitation, vibration transfer surface 255 can be part of a metal component, whereas the sidewall 246 can be a soft plastic or other soft material that is more comfortable for the recipient. Further, vibration transfer surface 255 can be a component that is configured to enhance maintenance of contact between the percutaneous vibration conductor 150 and the bone conduction device 240. By way of example only and not by way of limitation, in an exemplary embodiment, surface 255 can be an adhesive surface. For example, the surface 255 can be a chemical adhesive that adheres to the percutaneous vibration conductor 150. Alternatively, and/or in addition to this, surface 255 can be part of a permanent magnet and/or can be a ferromagnetic material, and at least a portion of the percutaneous vibration conductor 150 can be a ferromagnetic material and/or a permanent magnet as the case may be (discussed further below). Also, a permanent magnet and/or ferromagnetic material can be located in the housing of the BTE device such that the magnetic field of the permanent magnet located in the housing of the BTE device (or the permanent magnet that is a part of the percutaneous vibration conductor 150) extends through the housing so as to magnetically attract the percutaneous vibration conductor 150 to the BTE device and/or vice versa.

In a similar vein, a contacting surface of the percutaneous vibration conduction device 150 that contacts the BTE device 240 can also include a surface that is configured to enhance the maintenance of contact between the BTE device 240 and the percutaneous vibration conductor 150. For example, the contacting surface of the percutaneous vibration conductor 150 can include an adhesive thereon and/or the percutaneous vibration conductor 150 can include a ferromagnetic material (e.g. soft iron and/or a permanent magnet).

Also, in an exemplary embodiment, the contacting surfaces can have a texture that is conducive to enhancing the maintenance of contact between the BTE device and the percutaneous vibration conductor. For example, Velcro like structures can be located on the contacting surfaces. Still further by example, the contacting surfaces can have protrusions that create a slight interference fit between the two components (analogous to taking two hair combs or two hair brushes and pushing them towards each other such that the key/bristles interlock with each other).

Any device, system, and/or method that can enhance the maintenance of contact between the percutaneous vibratory conductor 150 and the BTE device 240 beyond that which results from the presence of the ear hook 290 and/or any grasping phenomenon resulting from the auricle 105 of the outer ear and the skin overlying the mastoid bone of the recipient (and/or any grasping phenomenon resulting from hair or magnetic attraction or skin aside from the outer ear or from clothing, etc., in devices other than a BTE device and/or glasses configured with an actuator, etc.).

That said, in an alternate embodiment, the BTE device 240 and/or the percutaneous vibration conductor 150 do not include components that enhance the maintenance of contact between those components beyond that which results from the presence of the ear hook 290 and/or any grasping phenomenon resulting from the auricle 105 of the outer ear and the skin overlying the mastoid bone of the recipient.

Accordingly, in an exemplary embodiment, the percutaneous vibration conductor 150 is non-rigidly coupled to the external component. In an exemplary embodiment of such an exemplary embodiment, this is owing to the use of adhesives that permit the orientation of the bone conduction device relative to the percutaneous vibration conductor to change while the percutaneous vibration conductor remains in contact with the BTE device. Still further, in an exemplary embodiment, the percutaneous vibration conductor 150 is magnetically coupled to the BTE device 240 such that the BTE device 240 is articulable relative to the percutaneous vibration conductor while the percutaneous vibration conductor 150 is magnetically coupled to the BTE device 240.

It is noted that the embodiment of FIG. 2B is depicted with vibration transfer surfaces 255 located on both sides of the BTE device. In this regard, an embodiment of a BTE device usable in at least some embodiments detailed herein and/or variations thereof includes a dual-side compatible BTE bone conduction device, as is depicted in FIGS. 2A and 2B.

In an exemplary embodiment of this embodiment, this enables the vibration transfer properties detailed herein and/or variations thereof resulting from the vibration transfer surface 255 to be achieved regardless of whether the recipient wears the BTE device on the right side (in accordance with that depicted in FIG. 1) or the left side (or wears two BTE devices). In a similar vein, the contact maintenance features can be located on both sides of the BTE device 240. That said, in alternate embodiments, the vibrational transfer service 255 and/or the contact maintenance enhancement features are located only on one side of the BTE device 240. Still further, some embodiments can be practiced without the vibration transfer surfaces located on one or both sides (or anywhere on the BTE device) where the BTE device still functions as a dual-side compatible BTE bone conduction device.

In an exemplary embodiment, the vibrator actuator 242 is a device that converts electrical signals into vibration. In operation, sound input element 202 converts sound into electrical signals. Specifically, these signals are provided to vibrator actuator 242, or to a sound processor (not shown) that processes the electrical signals, and then provides those processed signals to vibrator actuator 242. The vibrator actuator 242 converts the electrical signals (processed or unprocessed) into vibrations. Because vibrator actuator 242 is mechanically coupled to sidewalls 246 (or to vibration transfer surface is 255), the vibrations are transferred from the vibrator actuator 142 to the percutaneous vibration conductor 150 (and then into the recipient bypassing at least the outer layer of skin of the recipient, as will be detailed further below).

It is noted that the BTE device 240 depicted in FIGS. 2A and 2B is but exemplary. Alternate embodiments can utilize alternate configurations of a BTE device.

It is further noted that in some embodiments, a BTE device is not used. Instead, an external device including the actuator and or other components that can enable the teachings detailed herein and/or variations thereof to be practiced (e.g. the transfer of vibrations faced on captured sound generated by an actuator mounted externally on the recipient to the percutaneous vibration conductor 150) can be utilized. By way of example only and not by way of limitation, in an exemplary embodiment, a removable component of a bone conduction device (passive transcutaneous bone conduction device and/or percutaneous bone conduction device modified with a pressure plate, etc.) can be attached to a recipient via a soft band connection extending about a recipient's head such that contact between the external component and the percutaneous vibration conductor 150 is achieved. In an alternative embodiment, contact can be achieved or otherwise maintained via one or more or all of the devices disclosed in U.S. Patent Application Publication No. 2013/0089229. Any device, system, and/or method that can enable the teachings detailed herein and/or variations thereof with respect to achieving and/or maintaining contact between the removable component of the bone conduction device and the percutaneous vibration conductor 150 so that a bone conduction hearing percept can be achieved can be utilized in at least some embodiments.

Figure 3A:
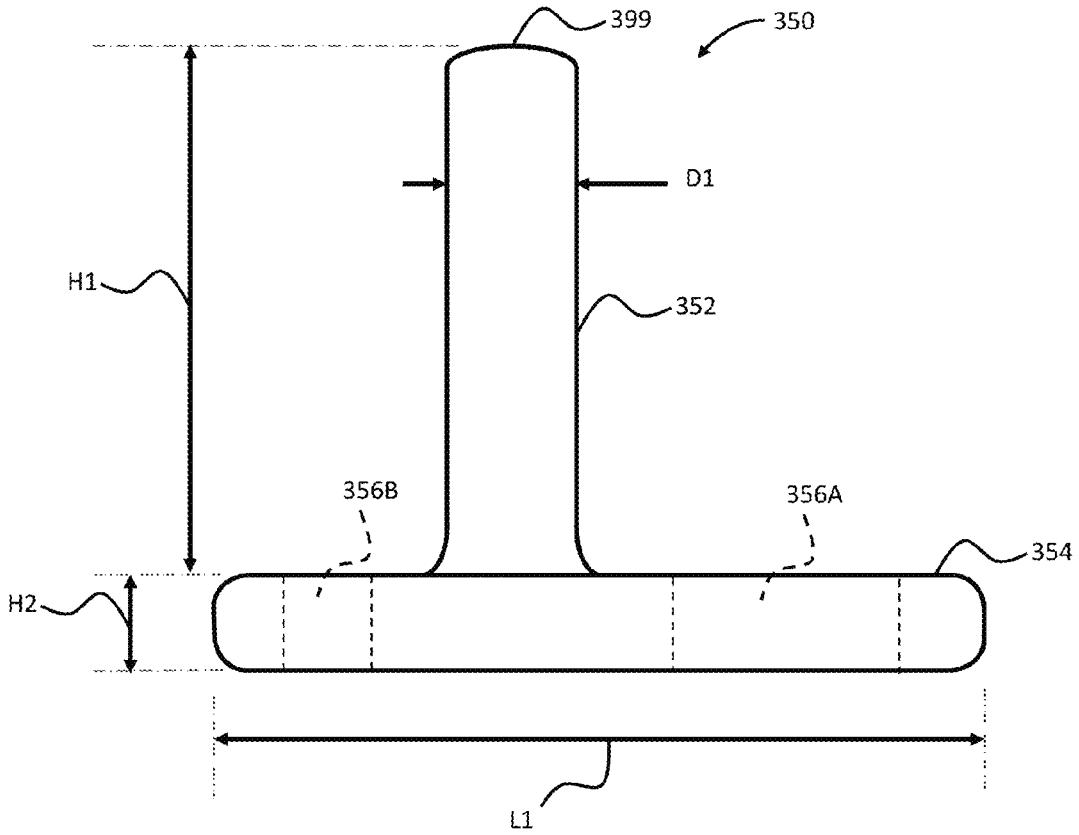
FIGS. 3A and 3B depict an exemplary percutaneous vibration conductor according to an exemplary embodiment.
Figure 3B:
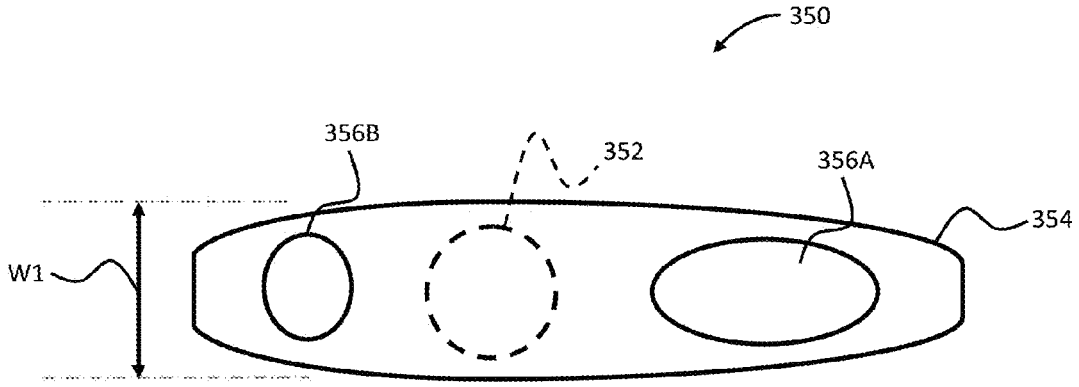

FIGS. 3A and 3B depict an exemplary percutaneous vibration conductor 350, which corresponds to percutaneous vibration conductor 150 detailed above. FIG. 3A is a side view of the exemplary percutaneous vibrational conductor 350, and FIG. 3B is a bottom view of the percutaneous vibration conductor 350. As can be seen, the percutaneous vibration conductor 350 includes a skin penetrating shaft 352 that extends in the longitudinal direction of the percutaneous vibration conductor 350 from a platform 354 that extends in the lateral direction away from the shaft 352 in two directions. Details of how the percutaneous vibration conductor 350 interfaces with the anatomy of the recipient are provided in greater detail below. The structure of the percutaneous vibration conductor 350 will first be described.

In an exemplary embodiment, the outer profile of the percutaneous vibration conductor 350 is that of an inverted "T" shape. In an alternate embodiment, the outer profile of the percutaneous vibration conductor 350 is that of an "L" shape. With respect to the embodiment specifically depicted in FIGS. 3A and 3B, the outer profile of the percutaneous vibration conductor 350 is between an "L" shape and an inverted "T" shape. In this regard, the portions of a platform 354 extend in opposite directions away from the shaft 352, with one portion extending a further distance from the shaft 35 to the other portion. That said, in an alternate embodiment, both portions of the platform 354 can extend a distance that is at about equal (including equal). Alternatively, embodiments can be such that the outer profile of the percutaneous vibration conductor 350 is that of an "L" shape, where there is only extension of the platform 354 in one direction. Accordingly, in an exemplary embodiment, the percutaneous vibration conductor 350 includes a laterally extending component (e.g., platform 354) configured to extend underneath the skin of the recipient and a longitudinally extending component (e.g., shaft 352) configured to extend through the skin of the recipient. In this exemplary embodiment, laterally extending component extends a substantial distance in a direction at least approximately normal to the direction of extension of the longitudinally extending component.

Referring to FIG. 3A, as can be seen, the shaft 352 has a height H1 that is about 4 mm to about 14 mm. The shaft 352 has a maximum diameter D1 of 4 mm. The platform has a height H2 that is about 0.25 mm to about 1 mm and a length L1 of about 5 mm to about 10 mm. Referring to FIG. 3B, the platform has a maximum width W1 of about 2 mm to about 5 mm. In at least some embodiments, at least some of the aforementioned dimensions are based on the local skin thickness of the recipient. Thus, in an exemplary embodiment, there is a method that entails evaluating the thickness of the skin at the location where the hole through the skin will be created, and sizing the conductor accordingly (e.g., selecting a conductor having a height H1 based on the skin thickness).

In the exemplary embodiment of FIGS. 3A and 3B, the shaft 352 is of sufficient length such that when the platform is located against bone and/or in relatively close proximity to bone, the shaft extends through the soft tissue of the recipient (muscle, fat and skin) to a location substantially flush and/or proud of the surface of the skin at the location where the shaft 352 emerges from the recipient. This can be such that the contact surface 399 at the end of the shaft 352 can abut the BTE device such that vibrations generated by the BTE device can be directly conducted directly from the BTE device to the percutaneous vibration conductor 350 to thereby evoke a bone conduction hearing percept. In this regard, surface 399 is any surface that can enable such conduction to take place. In the embodiment of FIG. 3A, the surface is depicted as being curved in shape (concave relative to the platform 354/convex relative to the BTE device). In an alternate embodiment, as detailed below, contact surface 399 can be flat. In alternative embodiment, contact surface 399 can be convex in shape relative to the platform 354. Furthermore, contact surface 399 can be a surface that is not uniform and/or not smooth. In this regard, contact surface 399 can comprise a plurality of protrusions extending away from the platform 354. These protrusions can correspond to, for example, bumps at the end of the shaft 352. Contact surface 399 can include any of the features detailed herein with regard to maintaining and/or enhancing contact between the BTE device and the contact surface 399. Furthermore, contact surface 399 need not be symmetric about the longitudinal axis of the shaft 352. For example, the contact surface can have a grade (e.g., a slope) relative to the direction normal to the longitudinal axis of the shaft 352. In an exemplary embodiment, this grade can enable increased overall contact with the BTE device (i.e., the average distance between the respective contact surfaces on a per unit basis is lower relative to that which would be the case in the absence of such a surface, where a distance of 0 mm corresponds to contact between the respective surfaces) in scenarios where the shaft 352 extends towards the BTE device at an oblique angle. For example, if the shaft 352 extends towards the vibration transfer surface 255 at a direction of 15° from normal, surface 399 can be for example a flat surface that is angled at 15° relative to the direction normal to the longitudinal axis of the shaft 352, thus at least presenting in theory complete contact between the contact surface 399 and the vibration transfer surface 255 of the BTE device. Indeed, in some alternate embodiments, the end of the shaft 352 can be gimbaled (mechanically or flexibly, or by any other means that can enable increased contact relative to that which would be the case in scenarios where the shaft extends at an oblique angle from the surface of the BTE device) the contact surface 399 aligns to that of the interfacing portion of the BTE device. Note further that in some embodiments, the BTE device can include a receptacle to receive at least a portion of the shaft 352. The receptacle can be dimensioned to receive a substantial portion of the shaft (e.g., about 10%, about 15%, about 20%, etc., of the length of the shaft) and/or can be dimensioned to receive a relatively limited portion of the shaft (e.g. receptacle can be a divot that receives a portion of the surface 399 or all of the surface 399). In some embodiments, the receptacle results in a slip fit between the two components such that the components are rigidly coupled to one another with respect to the application of a moment applied on a plane normal to the longitudinal axis of the shaft 352 (analogous to a dowel pin extending from a bearing). In some embodiments, the receptacle results in a fit such that the receptacle aligns the shaft 352 with the BTE device (analogous to a drinking glass with a straw therein.) In some embodiments, the shaft of the percutaneous vibration conductor is configured with a depth gauge or stopper on the shaft that prevents over insertion into the BTE device.

Any device, system, and/or method that can enable the end of the shaft 352 to contact the BTE device to enable bone conduction hearing percept to take place can be utilized in at least some embodiments.

In an exemplary embodiment, the bottom (i.e., the side facing the bone of the recipient when inserted/implanted therein) of the platform 354 is configured to surface mount on bone of the recipient, as can be seen in FIG. 1. However, in at least some embodiments, as will be detailed below, embodiments can be practiced where the platform 354 does not come into contact with the bone (this can be done even for embodiments where the platform 354 is configured to surface mount on bone). Further, in at least some embodiments, also as will be detailed below, while the platform 354 is configured to surface mount on bone, without any portion thereof extending below a local surface of the bone, embodiments can be practiced where the platform 354 becomes at least partially encapsulated by bone via bone growth around at least some portions of the platform 354. This is as contrasted to a traditional implant of a percutaneous bone conduction device, which has a substantial portion of the skin penetrating component (combined abutment and bone fixture) that extends below a local surface of the bone (e.g., a portion of the bone fixture extends into the bone).

Accordingly, in an exemplary embodiment, where X is the height of the percutaneous vibration conductor (i.e., the distance from the bottommost portion (the portion that is closest to the surface of the bone with respect to conductors that do not penetrate the surface of the bone or the portion that extends deepest into the bone after implantation with respect to conductors that penetrate the surface of the bone) to the top-most portion of the conductor (the portion that abuts the contact surface of the BTE device or the portion that protrudes the furthest into the BTE device) (H1+H2 with respect to the embodiment of FIG. 3A) and Y is the furthest distance of penetration below the surface of the bone after implantation (zero in the embodiment of FIG. 3A), X/Y equals about a value within the range of 0.0 to about 0.3 or any value or range of values therebetween in about 0.01 increments. (e.g., 0.0, 0.01, 0.1, about 0.03 to about 0.24, etc.).

In at least some embodiments, the platform 354 is configured to resist relative movement of the percutaneous vibration conductor 150 in a direction below the surface of the bone (i.e., movement in the longitudinal direction into the bone/a direction normal to the tangent plane of the local surface of the bone). More particularly, because the shaft 352 extends from within the recipient away from the bone of the recipient to a location outside the recipient such that the removable component of the bone conduction device (e.g., BTE device, etc.) abuts the end of the shaft 352, in the absence of the platform 354, a force applied to the removable component of the bone conduction device and/or to the shaft 352 can result in that force being transferred to the bone of the recipient. Accordingly, an exemplary embodiment includes a platform 354 that has a bottom surface having an area that distributes the force such that the resulting pressure (force divided by area) is below that which would be expected to cause at least serious damage to the bone of the recipient with respect to expected forces applied to the percutaneous vibration conductor 350 in the longitudinal direction towards the bone.

In the embodiment of FIGS. 3A and 3B, the profile of the platform 354 is configured to provide sufficient resistance to relative movement (i.e., movement relative to the recipient) in the longitudinal direction towards the bone to achieve the just noted features (i.e., movement towards the recipient). In the embodiment of these figures, the profile of the platform 354 is also configured to provide sufficient resistance to localized pressure in the longitudinal direction towards the bone to avoid and/or substantially reduce the possibility that localized pressure will increase to a level deleterious to the bone/skull.

With respect to these figures, it can be seen that the shaft 352 has a circular cross-section lying on the plane normal to the longitudinal direction of the shaft 352 (e.g., lying on a plane normal to a direction of skin penetration). In an exemplary embodiment, an outer diameter of the shaft 352 lying on that plane is less than about half of the maximum diameter of the platform 345 also lying on a plane normal to the direction of the shaft 352. In the embodiments of FIGS. 3A and 3B, this is achieved because the length of the platform 354 (i.e., the dimension of the horizontal direction in FIG. 3B) is over twice that of an outer diameter of the shaft. Alternatively and/or in addition to this, this can be achieved because the width of the platform 354 (i.e., the dimension of the vertical direction in FIG. 3B) is over twice that of an outer diameter of the shaft 352. That said, in alternate embodiments, these relations may be different. Any configuration of the platform that can enable the just described resistance can be utilized in at least some embodiments. Still further, while the aforementioned dimensions have been described in terms of the longitudinal axis of the shaft 352 being coaxial with the direction of skin penetration, in alternate embodiments, the longitudinal axis of the shaft 352 may not be coaxial with the direction of skin penetration.

In the embodiment of FIGS. 3A and 3B, the profile of the shaft 352 and the platform 354 can enable insertion of the percutaneous vibration conductor 350 through the puncture in the skin of the recipient above the mastoid bone so that the percutaneous vibration conductor 350 can be positioned approximately in the manner detailed above in FIG. 1 and/or according to other utilitarian positioning's as detailed herein and/or variations thereof that can enable the teachings detailed herein to be practiced. Additional features of this concept are described below with respect to methods of insertion of the percutaneous vibration conductor 350. Briefly, however, as can be seen in the figures, the profiles of the percutaneous vibration conductor 350 are generally streamlined to enable relatively smooth insertion of the percutaneous vibration conductor 350 into a puncture in the skin that extends from the skin surface to the mastoid bone and/or close to the mastoid bone (at least a distance through the skin such that the platform 354 can be inserted under the periosteum). In this regard, the platform 354 is in the form of a truncated oblong ellipse. While the front end and the rear end of the platform 354 does include a blunt portion, the curvatures of the portions of the platform 354 extending away from those blunt portions are such that the blunt portions generally do not interfere with insertion into the puncture. Indeed, in at least some embodiments, the blunt portions can reduce the likelihood that the platform 354 can be deleteriously caught onto the skin during the insertion process, at least in embodiments where such a scenario is not seen is utilitarian or otherwise desirable.

That said, in an alternate embodiment, one or both of the ends of the platform 354 can be configured such that instead of blunt ends, more streamlined ends are present (e.g., completely curved ends). Conversely, in at least some embodiments, one or both of the ends can be relatively sharp so as to allow for insertion of the percutaneous vibration conductor into the recipient without a previously created puncture into the skin.

In at least some embodiments, the platform is in the form of a beam extending away from a longitudinal axis of the percutaneous vibration conductor (e.g., the axis of the shaft 352). Any configuration of the platform 354 that can enable the percutaneous vibration conductor 350 to be inserted into recipient according to the teachings detailed herein and/or variations thereof can be utilized providing that such can enable the teachings detailed herein and/or variations thereof.

In an exemplary embodiment, the platform 354 is configured to enhance osseointegration of at least the platform 354 to bone 136 of the recipient, or at least enable tissue of the recipient, whether it be bone or soft tissue (e.g., skin, fat and/or muscle, etc.) to grow into the platform 354 to aid in securing the percutaneous vibration conductor 150 to the recipient. In this regard, platform 354 includes through holes 356A and 356B that extend completely through the platform 354 from a bottom (i.e., the side facing bone when implanted in the recipient) to the top (i.e., the side facing the BTE device/the side facing the surface of the skin when implanted in the recipient) of the platform. In an alternate embodiment, there are no through holes through the platform 354. Still further, in an alternate embodiment, there is only one through hole in the platform 354, while in alternate embodiments there are three or more holes through the platform. As can be seen from FIG. 3B, in an exemplary embodiment, the through holes 356A and 356B are elliptical in shape. In alternative embodiments, one or more or all of the through holes can be circular, rectangular (square or otherwise) etc. Any size, shape or configuration of holes can be utilized to enhance osseointegration and/or to promote or otherwise enable tissue growth to grow into the platform providing that the teachings detailed herein and/or variations thereof can be practiced.

Still further, in an exemplary embodiment, at least some of the surfaces of the platform 354 can be coated with a substance that enhances osseointegration. By way of example only and not by way of limitation, the bottom surface and/or the side surfaces of the platform 354 can be coated with hydroxyapatite. Alternatively and/or in addition to this, one or more of the surfaces can be roughened and/or patterned with a texture that promotes osseointegration. By way of example only and not by way of limitation, such patterning can be as will now be detailed.

Figure 3C:
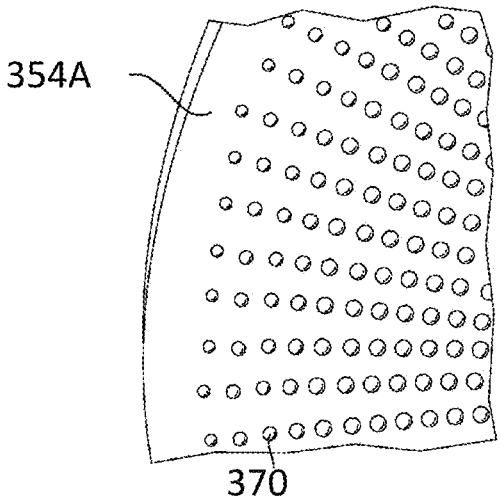
FIGS. 3C-3F depict exemplary surface configurations of exemplary percutaneous vibration conductors according to some exemplary embodiments.
Figure 3D:
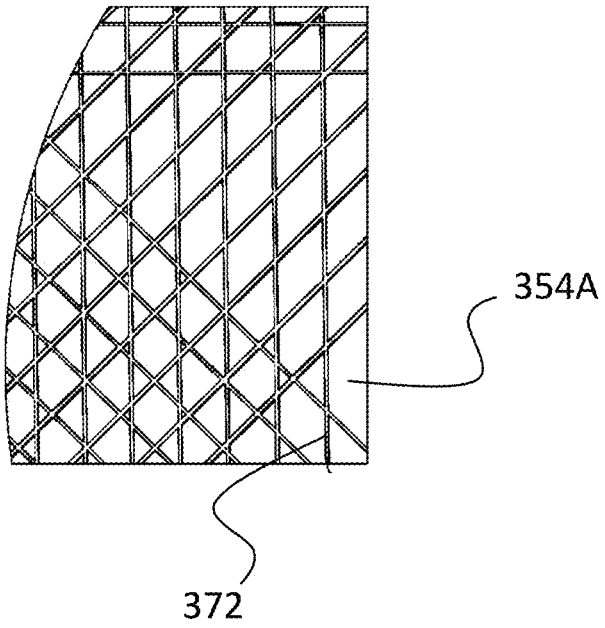
Figure 3E:
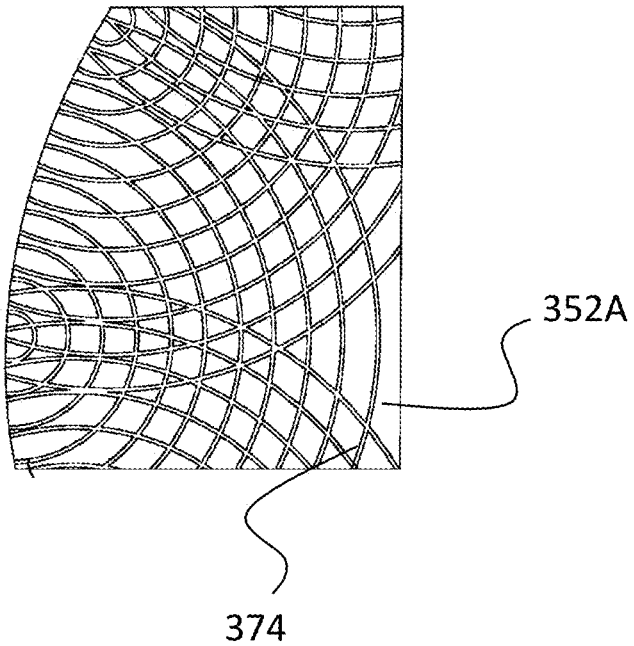

FIGS. 3C, 3D and 3E illustrate some exemplary surface features that may be formed at locations on some exemplary percutaneous vibration conductors in general, and at locations on the platform thereof in particular (e.g. a bottom surface and/or the side surfaces and/or the top surface). These figures depict the bottom surface of the platform 354. It is noted that the configurations of these figures can be applied at other locations providing that the teachings detailed herein and/or variations thereof can be practiced in a utilitarian manner.

More specifically, by way of example only and not by way of limitation, the bottom surface of the platform 354 can include one or more of the surface features shown in FIGS.

3D-3E, which, in some embodiments, are patterned microstructures that are configured to promote osseointegration of an implantable component with a recipient's skull bone.

FIG. 3C illustrates an arrangement in which a plurality of rounded or dome-shaped protrusions 370 extend from a bottom surface 354A of the platform 354. It is noted that in some embodiments, the protrusions shown in FIG. 3C can be used in combination with a porous scaffold described below. In certain such embodiments, a bottom surface may include both osteoconductive pores and protrusions.

FIGS. 3D and 3E illustrate further embodiments in which the surface features comprise a pattern of grooves disposed in a bottom surface 354A of the platform. More specifically, FIG. 3D illustrates a pattern of intersecting linear grooves 372 (i.e., grooves formed as straight lines) in surface 354A. FIG. 3E illustrates a pattern of intersection curved grooves 374 (i.e., grooves formed as curved lines) in surface 352A. The grooves 372 and/or 374 may have a depth in the range of approximately 50 micrometers to approximately 200 micrometers and a width in the range of approximately 70 micrometers to approximately 350 micrometers.

The shape of the grooves in the embodiments of FIGS. 3E and 3D are configured to promote bone growth in a direction that is substantially perpendicular to a surface of the recipient's skull.

In certain embodiments of FIGS. 3D and 3E, one or more of the grooves include portions that, when the percutaneous vibration conductor is implanted, are substantially parallel to a surface of the recipient's skull to promote bone growth in a direction that is substantially parallel to the surface of the recipient's skull. In other embodiments, one or more of the grooves include portions that, when the implantable component is implanted, are positioned at an angle relative to a surface of the recipient's skull to promote bone growth at an angle relative to the surface of the recipient's skull.

As with the embodiment of FIG. 3C, the embodiments of FIGS. 3D and 3E can be in combination with a porous scaffold as described below. In certain such embodiments, the bottom surfaces of the platform (and/or other surfaces) may include both osteoconductive pores (as described below) and grooves as described above. Again, in at least some embodiments, any one or more of the teachings detailed herein can be combined with any one or more other teachings detailed herein.

Figure 3F:
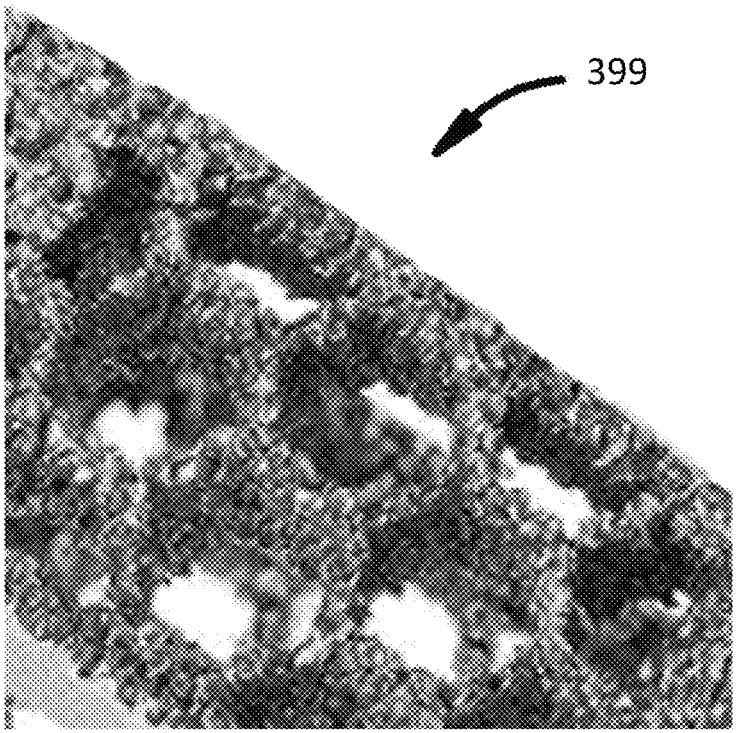

FIG. 3F illustrates an exemplary structure usable in at least some embodiments of some exemplary percutaneous vibration conductors in general, and with some exemplary platforms in particular. Specifically, FIG. 3F depicts an implantable component that has a trabecular (bone-like) structure/a three-dimensional structure. More specifically, FIG. 3F illustrates an enlarged view of a portion 399 of a body of an implantable component (which can correspond to the platform) configured to be implanted adjacent to/on a recipient's bone and is configured to promote bone ingrowth and/or ongrowth to interlock the implantable component with the recipient's bone. In the embodiments of FIG. 3F, at least a portion of the platform is a porous-solid scaffold that comprises an irregular three-dimensional array of struts. In an exemplary embodiment, the irregular scaffold of FIG. 3F allows for vascular and cellular migration, attachment, and distribution through the exterior pores into the scaffold. The porous solid scaffold of FIG. 3F may be formed, for example, from a solid titanium structure by chemical etching, photochemical blanking, electroforming, stamping, plasma etching, ultrasonic machining, water jet cutting, electrical discharge machining, electron beam machining, or similar process.

Embodiments utilizing the structure of FIG. 3F provide an osteoconductive implantable component that has a porous structure to facilitate bone ingrowth and/or ongrowth so as to interlock the implantable component with the recipient's skull bone. In the above embodiments, the bottom (i.e., bone-facing) surface has the same structure as the rest of the implantable component (i.e., generally porous).

Such structures can be referred to herein as a porous-solid scaffold. Some exemplary embodiments of a porous-solid scaffold that can be utilized with embodiments detailed herein and/or variations thereof are disclosed in U.S. patent application Ser. No. 14/032,247, filed on Sep. 20, 2013, naming Goran Bjorn and Jerry Frimanson as inventors.

In an exemplary embodiment, porous-solid scaffold forms at least a portion of the surface of the platform. In an exemplary embodiment, the porous-solid scaffold extends a certain depth below the surface of the platform. That is, in an exemplary embodiment, the entire platform is not a porous-solid scaffold.

Figure 4:
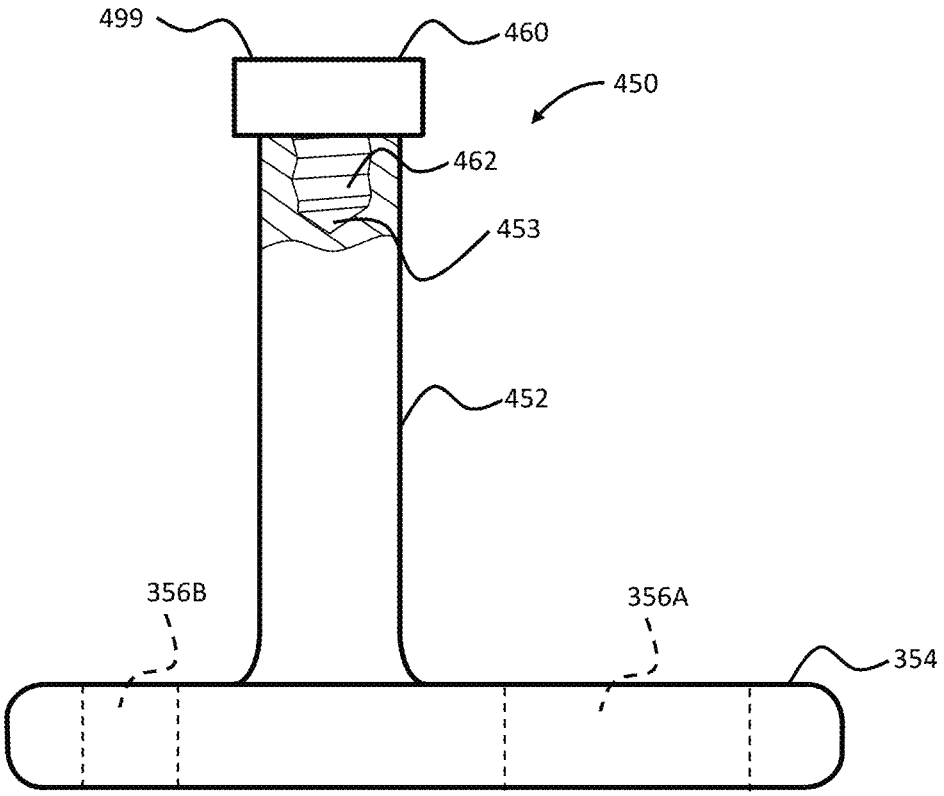
FIGS. 4 and 5 depict other exemplary percutaneous vibration conductors according to other exemplary embodiments.

FIG. 4 depicts an alternate embodiment of percutaneous vibration conductor 450 corresponding to the conductor 150 of FIG. 1, with like reference numbers associated with the embodiment of FIGS. 3A and 3B re-utilized for the sake of visual and textual efficiency. In this regard, as can be seen in FIG. 4, percutaneous vibration conductor 450 includes a cap 460 located at the end of the skin penetrating shaft 452 that includes a male component 462 that fits into a bore 453. In an exemplary embodiment, male component 462 is a threaded component (male thread) and bore 453 is a mating threaded component (female thread). In an alternate embodiment, the male component 462 is a smooth component and the female is a smooth component that fit together via an interference fit or via an adhesive etc. In an alternate embodiment, the male component 462 can snap-fit into the bore 453. Cap 460 can be a removable component from the remainder of the percutaneous vibration conductor 450, the remainder which can be a monolithic component (as can be the case with percutaneous vibration conductor 350 detailed above, where for example, percutaneous vibration conductor 350 can be made from a single casting of material (e.g., metal or other vibrating transmitting components)).

In the embodiment of FIG. 4, cap 460 can be utilized to provide additional utilitarian features of the percutaneous vibration conductor 450. By way of example only and not by way of limitation, cap 460 can be made of and/or can include a ferromagnetic material and/or a permanent magnet. This can have utility with respect to creating an attraction between the percutaneous vibration conductor and the BTE. This can have utility in embodiments where the remainder of the percutaneous vibration conductor is made of a non-ferromagnetic material (e.g., titanium) and/or where there is utilitarian value in concentrating the magnetic attraction at the end of the shaft 452. That is, while some embodiments of the percutaneous vibration conductor 350 of FIGS. 3A and 3B can be made of a ferromagnetic material (at least at the area proximate the contact surface 399), the embodiment of FIG. 4 provides the flexibility of enabling the magnetic forces to be concentrated at the contact surface 499 that contact the BTE device during normal use of the percutaneous vibration conductor 450. Alternatively and/or in addition to this, while the contact surface 499 is depicted as a surface having no slope relative to the direction normal to the longitudinal direction of the shaft 452, as noted above, in at least some embodiments, there is utilitarian value in having a contact surface that is different from the flat/non-sloped configuration. In this regard, in at least some embodiments, depending on the physiology of the recipient and/or the habits of the recipient (e.g., jogger, sedentary, etc.) different types of contact surfaces can be utilitarian. As noted above, in at least some embodiments the orientation of the skin penetrating shaft 452 is that of an oblique angle intercepting the surface of the BTE device (relative to the tangent line/tangent plane of the surface of the BTE device that contacts the percutaneous vibration conductor). Cap 460 can come in a plurality of configurations such that it can provide the percutaneous vibration conductor 450 to be configured with different contact surface 499 angles relative to the direction normal to the longitudinal axis of the shaft 452 such that a match (at least a theoretical match) between the contact surface 499 and the respective corresponding contact surface of the BTE device can be achieved even though humans have different physiologies and/or the percutaneous vibration conductor can utilize with different types of BTE devices having different configurations.

Alternatively and/or in addition to this, cap 460 can enable the contact surface to be replaced in the event of wear, damage, a change in the recipient's physiology and/or a change in the BTE device used with the percutaneous vibration conductor.

Figure 5:
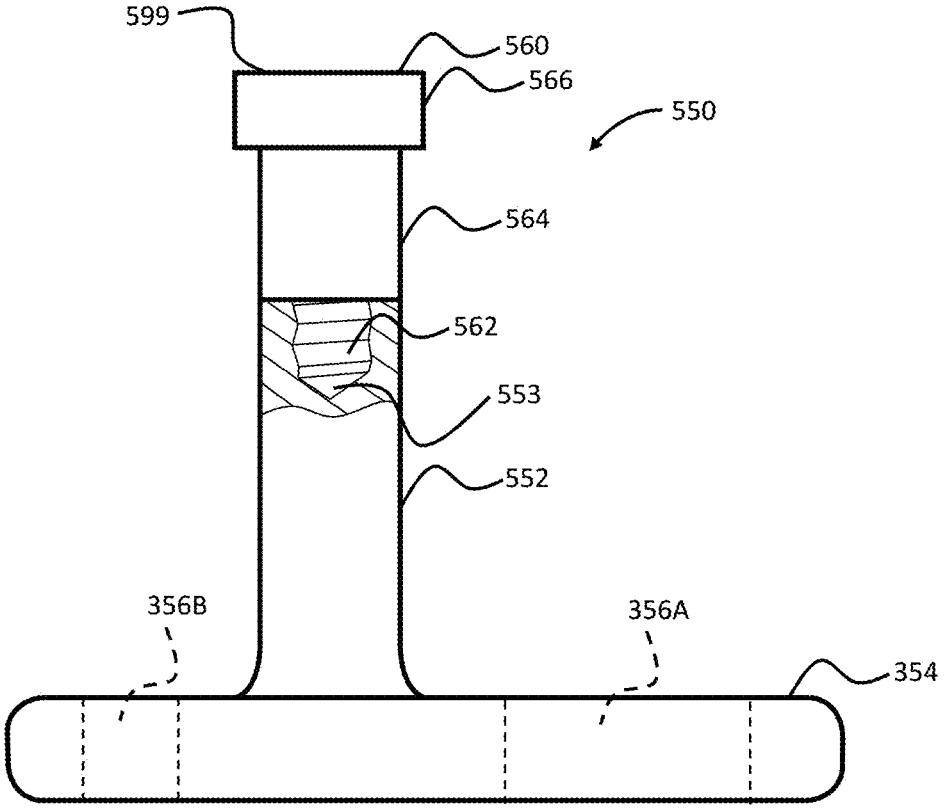

Referring now to FIG. 5, there is an alternate embodiment of a percutaneous vibration conductor 550 that corresponds to percutaneous vibration conductor 150 detailed above. As can be seen, shaft 552 extends a distance from the platform 354 that is less than that of the shafts of the embodiments of FIGS. 3A, 3B and 4. As with the shaft 452 of the embodiment of FIG. 4, there is a female threaded bore 553 into which threads 562 of shaft extender 560 extend. Shaft extender 560 includes a shaft section 564 which has an outer diameter that is at least about the same as that of shaft 552. Percutaneous vibration conductor 550 optionally includes a head 566 which can correspond to the configuration of the cap 460 of the embodiment of FIG. 4.

With respect to the embodiment of FIG. 5, this feature can enable the skin penetrating shaft of the percutaneous vibration conductor to be extended or reduced in the event that the local skin thickness of about the percutaneous vibration conductor changes (e.g., due to growth, due to a change in diet, etc.). This can be done without having to remove the platform 354 from the recipient, which can have utility in at least the case where the platform 354 is osseointergrated to the bone of the recipient, etc. Alternatively and/or in addition to this, this can enable a method of implantation where the length of the skin penetrating shaft can be adjusted or otherwise the length can be selected prior to implantation and/or after implantation to provide a wider range of implantation options/to provide for a customized distance of the surface 599 above the local surface of the skin (i.e. above the tangent plane of the surface of the skin that surrounds the shaft 552 and/or extender 564).

It is noted that while the embodiment of FIG. 5 depicts only one extender 560, alternate embodiments can utilize two or more extenders. It is further noted that in at least some embodiments, the configuration of the percutaneous vibration conductor 550 is such that the mating components between the extender 560 and the shaft 552 reduce the potential for bacterial ingrowth. Indeed, in at least some embodiments, it is noted that in at least some portions of the percutaneous vibration conductors detailed herein can be coated with a coating that reduces the likelihood of infections relative to that which would be the case in the absence of the coating. By way of example only and not by way of limitation, the coating can be made of hydroxyapatite. Any device, system or method of reducing the likelihood of infection relative to that which would be the case in the absence of such a device, system or method can be utilized in at least some embodiments with respect to application to the percutaneous vibration conductors detailed herein and/or variations thereof.

Some embodiments associated with the implantation of the percutaneous vibration conductor will now be described with reference to the embodiment of FIG. 4.

Figure 6A:
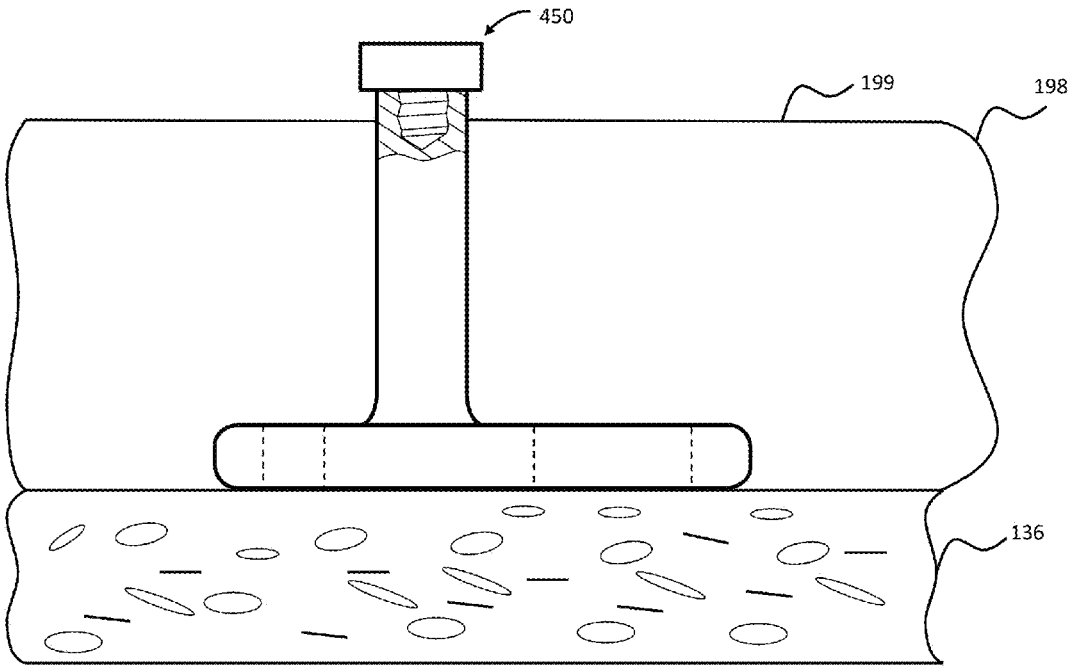
FIGS. 6A to 6D depict some exemplary implantation regimes of some exemplary percutaneous vibration conductors according to some exemplary embodiments.

FIG. 6A depicts a percutaneous vibration conductor 450 surface mounted on bone 136 of the recipient. As can be seen, shaft 452 extends through the soft tissue 198 (muscle, fat, and skin) to a location proud of the surface of the skin 199. (That said, as noted above, in at least some embodiments, the shaft extends only to a location that is substantially flush with the surface 199 of the skin.) Also as can be seen in FIG. 6A, the bottom surface of the platform 354 is substantially parallel to the tangent plane of the surface of the bone 136. In this regard, the bottom surface of the platform 354 directly abuts the surface of bone 136. It is noted that the embodiment of FIG. 6A can correspond to a temporal location subsequent to implantation at and/or shortly after implantation (a few minutes, a few hours, a few days after implantation). As will be detailed below the positioning of the percutaneous vibration conductor 450 relative to the bone 136 is concomitant with subsequent osseointegrated percutaneous vibration conductors.

Figure 6B:
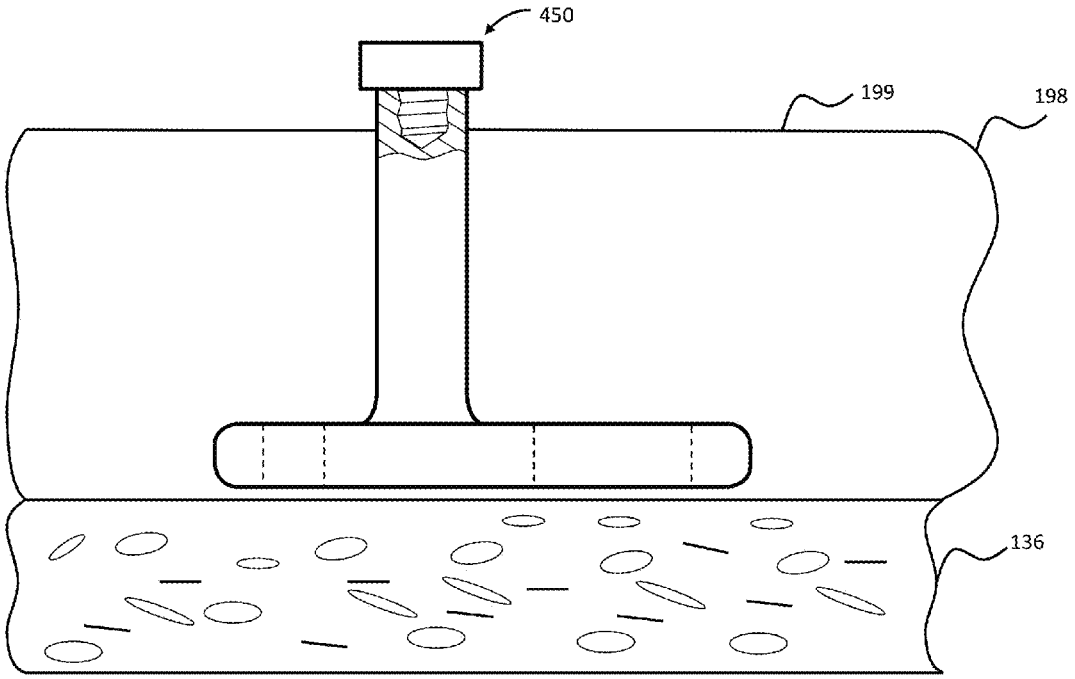

The embodiment of FIG. 6B depicts an alternate implantation regime of the percutaneous vibration conductor 450, where soft tissue 198 is utilized to support the percutaneous vibration conductor. In this regard, FIG. 6B depicts an arrangement for a bone conduction hearing prosthesis including an external component (e.g., the BTE of FIG. 1, not shown in FIG. 6B) and a skin penetrating component (percutaneous vibration conductor 450) abutting the external component configured to transfer the vibrations at least partially beneath the skin of the recipient. In the embodiment of FIG. 6B, skin penetrating component is at least substantially supported by soft tissue. Unlike the embodiment of FIG. 6A, the skin penetrating component in general, and the platform 354 thereof in particular, is at least substantially supported by soft tissue 198. More particularly, in the embodiment of FIG. 6B, the percutaneous vibration conductor 450 does not directly contact the bone 136 of the recipient. Instead, a section of soft tissue (skin, fat and/or muscle) is interposed between the bottom surface of the platform 354 and the surface of the bone 136. In the exemplary embodiment of FIG. 6B, vibrations traveling through the percutaneous vibration conductor 450 are conducted from the percutaneous vibration conductor 450 to the soft tissue 198 to reach bone 136. Such an embodiment can have utility in that the vibrations are conducted through at least a portion of the soft tissue 198 to a location closer to the bone relative to that which would be the case in the scenario where there was no percutaneous vibration conductor 450 (e.g., in the scenario where the BTE device abuts the skin of the recipient and the vibrations from the BTE device are communicated entirely through the skin of the recipient to the bone of the recipient). Accordingly, the exemplary embodiment of FIG. 6B reduces the dampening effect of the skin relative to that which would be the case in the latter scenario. In a similar vein, while conducting the vibrations from the BTE device entirely through the skin of the recipient directly to the bone utilizing the percutaneous vibration conductor 450 can result in the least amount of dampening of the vibrations, conducting those vibrations to a location beneath the surface of the skin of the recipient utilizing the percutaneous vibration conductors detailed herein and/or variations thereof can result in less dampening than that which would be the case if only soft tissue relied on to conduct the vibrations from outside the skin of the recipient.

Accordingly, in an exemplary embodiment, even though the percutaneous vibration conductor is not anchored to the bone, such embodiments have utilitarian value in that they at least bypassed some of the soft tissue (e.g. in some instances, a majority of the soft tissue), thereby transferring vibrations to a location in the recipient closer to the bone than that which would be the case in the absence of utilization of the percutaneous vibration conductor.

Still referring to FIG. 6B, because the platform 354 extends in the lateral direction of the percutaneous vibration conductor 450, the conductor 450 is still positively retained in the recipient via the soft tissue 198 (because, for example, the soft tissue overlies the platform 354, thus preventing the conductor 450 from being pulled out of the recipient with a pulling action in the longitudinal direction of the shaft). This is the case even without osseointegration and/or tissue growth in the holes through the platform of the percutaneous vibration conductor 450 (if present). Indeed, in the embodiment of FIG. 6B, the percutaneous vibration conductor 450 is configured to hook into soft tissue (e.g., skin, fat and/or muscle) of the recipient. That is, the platform 354 extends through the soft tissue 198 of the recipient such that it is surrounded on all sides by soft tissue.

Figure 6C:
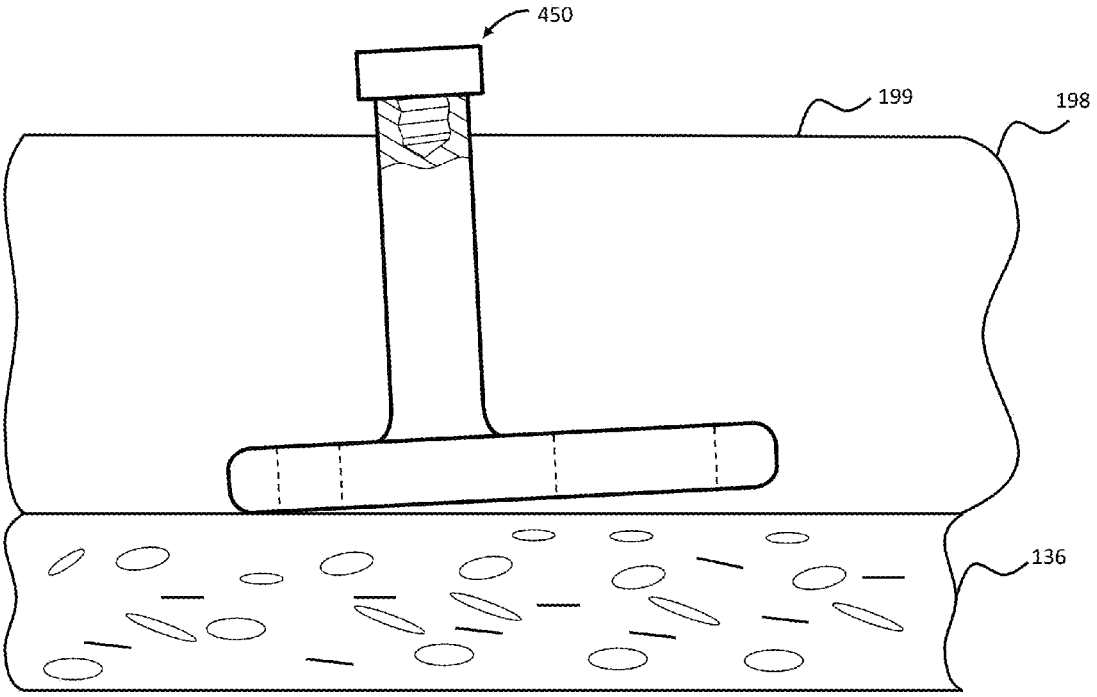

The embodiment of FIG. 6C depicts another alternate implantation regime of the percutaneous vibration conductor 450, where soft tissue 198 is utilized in combination with bone 136 to support the percutaneous vibration conductor. In this regard, FIG. 6C depicts an arrangement where the percutaneous vibration conductor 450 in general, and the platform 354 thereof in particular, is partially supported by soft tissue 198 and partially supported by bone 136. More particularly, in the embodiment of FIG. 6C, only a portion of the bottom surface of platform 354 contacts bone 136 of the recipient, whereas at least some of the other portions of the bottom surface of the platform 354 are supported by a soft tissue 198. That is, a section of soft tissue (skin, fat and/or muscle) is interposed between a portion of the bottom surface of the platform 354 and the surface of the bone 136, and another portion of the bottom surface of platform 354 is in contact with bone 136. In the exemplary embodiment of FIG. 6C, vibrations traveling through the percutaneous vibration conductor 450 can be conducted from the percutaneous vibration conductor 450 directly to the bone and/or can be conducted from the percutaneous vibration conductor 450 to the soft tissue 198 to reach bone 136.

It is noted that as with FIG. 6A, the embodiment of FIGS. 6B and 6C can correspond to a temporal location subsequent to implantation at and/or shortly after implantation (a few minutes, a few hours, a few days after implantation). As will now be detailed, the positioning of the percutaneous vibration conductor 450 relative to the bone 136 depicted in FIGS. 6B and 6C is concomitant with subsequent osseointegrated percutaneous vibration conductors.

Figure 6D:
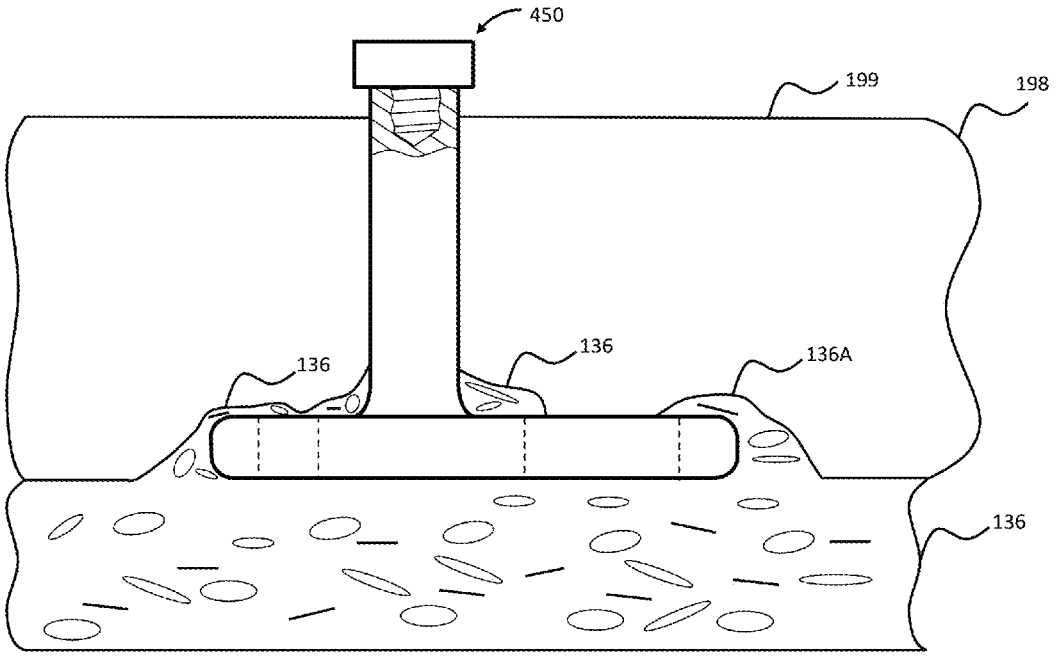

Referring now to FIG. 6D, there is depicted a percutaneous vibration conductor 450 where platform 354 is substantially osseointegrated to bone 136. More particularly, as can be seen from FIG. 6D as compared to FIG. 6A, bony tissue growth has occurred at a time subsequent to the implantation of the percutaneous vibration conductor 450, as evidenced by the additional bone tissue 136A. FIG. 6D depicts additional bone tissue 136A having grown around the sides of the platform 354, completely filling the through hole 356B and partially filling the through hole 356A. In this regard, FIG. 6D depicts a configuration of an implanted percutaneous vibration conductor 450 at a period of time after implantation corresponding to, by way of example only and by way of limitation, about 6 months, about 9 months, about 1 year, about a year and a half or more after implantation into the recipient.

Accordingly, the embodiment of FIG. 6D results in a percutaneous vibration conductor 450 secured to bone of the recipient via osseointegration. That said, in an alternate embodiment, osseointegration between the percutaneous vibration conductor 450 and bone 136 may not necessarily occur. For example, referring to the embodiment of any of FIGS. 6A, 6B and 6C, without osseointegration, the percutaneous vibration conductor 450 corresponds to a totally skin anchored skin penetrating component. In embodiments where a modicum of osseointegration occurs, but the substantial physical phenomenon that retains the percutaneous vibration conductor 450 at the implantation site is the fact that the soft tissue 198 overlays the top surface of the platform 354 and/or grows into holes 356A and/or 356B, the percutaneous vibration conductor 450 corresponds to a skin anchored penetrating component (which includes a totally skin anchored penetrating component). By "skin anchored," it is meant that the skin maintains the conductor 450 in the recipient. That said, it is noted that a percutaneous vibration conductor can be skin anchored and still include a bone penetrating component as detailed herein.

Figure 6E:
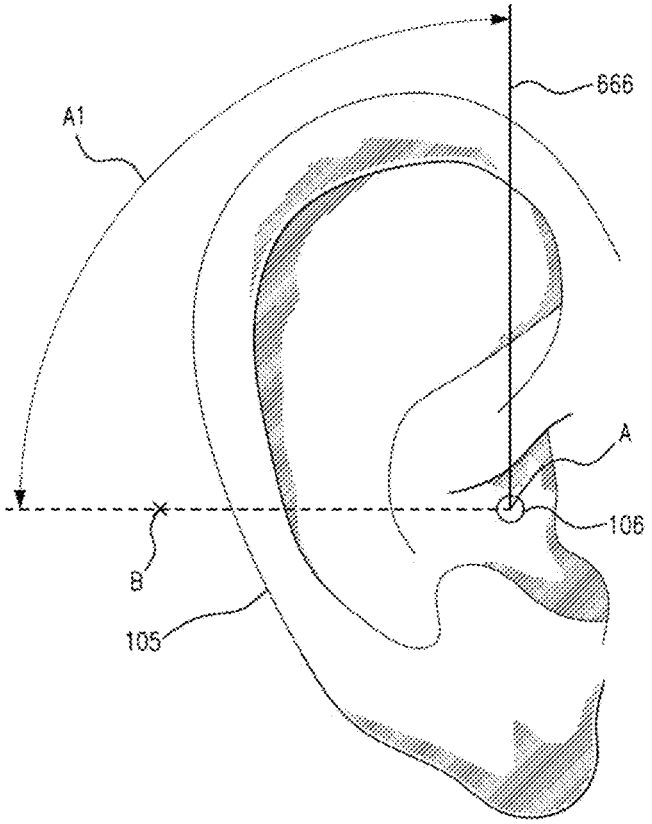
FIG. 6E depicts an exemplary location of an exemplary percutaneous vibration conductor relative to a side view of the outer ear according to an exemplary embodiment.

FIG. 6E depicts a side view of the view of FIG. 1 showing only the outer ear 105. This view shows an exemplary location for the percutaneous vibration conductors detailed herein and/or variations thereof relative to the side view of a human recipient. This embodiment is but an example of one location. Any location where the teachings detailed herein and/or variations thereof can be practiced can be utilized in alternate embodiments. More particularly, location A is the geometric center of the ear canal 106 when viewed from the side of the recipient. Location B is the geometric center of the shaft of the percutaneous vibration conductor when looking along the longitudinal axis thereof. In an exemplary embodiment, the distance between A and B in the side view is between about 25 mm to about 40 mm or any value or range of values therebetween in about 1 mm increments (e.g., about 28 mm, about 36 mm, about 30 mm to about 37 mm, etc.). Angle A1 indicates the angular offset of location B relative to location a as measured from a vertical line 666 that goes to the geometric center of the ear canal 106. In an exemplary embodiment, angle A1 can be an angle from about 40° to about 120° or any value or range of values therebetween in about 1° increments (e.g., about 90°, about 83°, 94°, about 57° to about 95° etc.).

That said, in an alternate embodiment, the location of the conductor can be further from the ear canal 106 than the aforementioned exemplary coordinates, which may be the case for use with a hair clip embodiment. Conversely, the location of the conductor can be closer to the ear canal than the aforementioned exemplary coordinates, which may be the case for use with a glasses embodiment. Also, the angle A1 can be greater or smaller than the aforementioned values. Again, any location that will enable the teachings detailed herein to be practiced can be utilized in at least some embodiments.

In an exemplary embodiment, the percutaneous vibration conductors detailed herein and or variations thereof are located such that they are against (or in the case of soft tissue support slightly above) the anatomically distinct bony ridge behind the ear of a human recipient. In particular, this bony ridge can be felt when rubbing a finger on the skin covering the skull just above where the ear is attached to the skull. In at least some embodiments, the bony ridge of the human anatomy just described has utilitarian value owing to the relative thickness of the bone in this location. Alternatively and/or in addition to this, in at least some embodiments, there is utilitarian value with respect to the fact that the skin in this area is typically very thin, about 2 mm to about 4 mm. By way of example only and not by way of limitation, for applications in this area, the length of the shaft is measured from the top of the platform to the end of the shaft on the side facing away from the platform can be about 4 mm to about 6 mm long or any value or range of values therebetween in about 0.1 mm increments.

It is noted that in alternate embodiments, the percutaneous vibration conductor can be located at other locations on the recipient.

Figure 7:
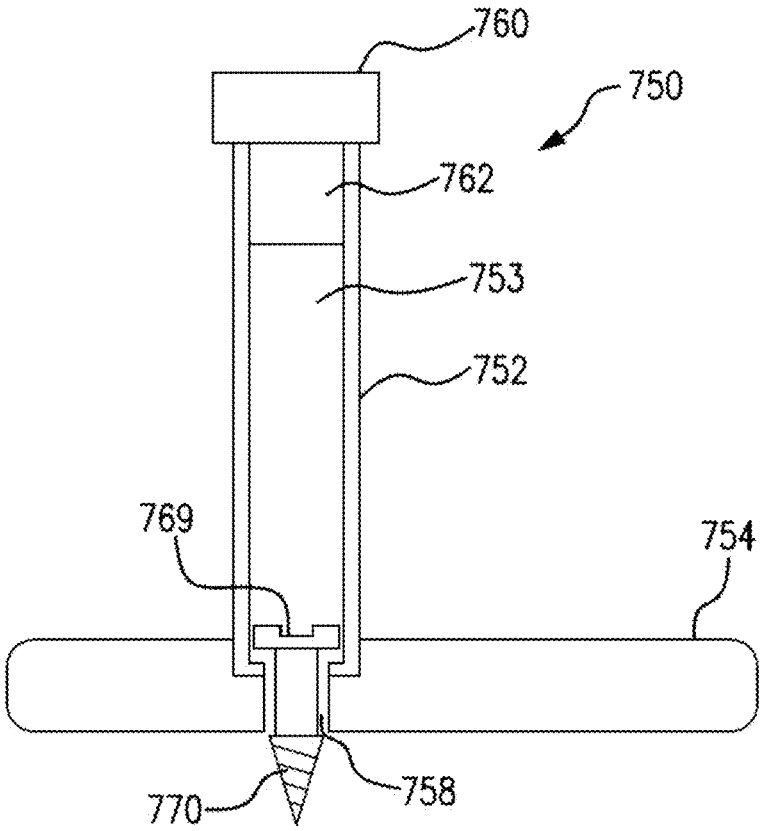
FIGS. 7 to 12 depict other exemplary percutaneous vibration conductors according to other exemplary embodiments.

FIG. 7 depicts another alternate embodiment of a percutaneous vibration conductor 750 corresponding to conductor 150 of FIG. 1, which includes a bone penetrating component 770 configured to maintain a position between the percutaneous vibration conductor 750 and the bone of the recipient, as will now be detailed.

In particular, percutaneous vibration conductor 750 includes a screw 770 configured to extend through a passage 758 extending through platform 754, as can be seen. It is noted that while embodiments disclosed herein utilize a screw, other types of devices that correspond to a bone penetrating component can be utilized (e.g., a spike, a barb(s), etc.). Screw 770 is retained to the percutaneous vibration conductor 750 owing to the geometry of the head of the screw (which has a component 769 configured to receive a wrench or a screwdriver or the like inserted through the bore 753 of shaft 752 to the screw 770, discussed in greater detail below) relative to the geometry of the mating portion of the shaft 752 (or, in alternate embodiments where the shaft 753 is a uniform hollow cylinder without the protrusions depicted in FIG. 7 that protrude inward towards the central axis of the shaft 752, relative to the geometry of the mating portion of the platform 754).

The percutaneous vibration conductor 750 includes a cap 760 located at the end of the skin penetrating shaft 752 that includes a plug portion 762 that can be threaded or interference fit or adhesively fit or fit in any manner utilitarian into the bore 753 of shaft 752. With respect to the embodiment of FIG. 7, cap 760 can be removable from the shaft 752 such that bore 753 can be accessed from the end of the shaft 752 that formally received the cap 760. Accordingly, with the cap 760 removed, the elongate portion of a wrench or a screwdriver can be inserted into the bore 753 so as to interface with the component 769 so that a torque may be applied to the screw 770 such that the screw 770 can be screwed into bone of the recipient. Alternatively, cap 760 is initially not located in the shaft 752 until after access to the screw 770 through the bore 753 to apply torque to the screw 770 is achieved, after which the cap 760 is placed into the shaft 752 to seal the bore 753. That is, the percutaneous vibration conductor 750 is inserted through the puncture of the skin into the recipient, and, subsequently, the screw 770 is screwed into the bone, and then the cap 760 is placed onto the shaft 752 to seal the bore 753.

In an exemplary embodiment, after the percutaneous vibration conductor 750 is placed through the skin of the recipient to be located in the recipient according to one or more of the scenarios of FIGS. 6A to 6D and/or variations thereof, a torque is applied to the screw 770 through the bore 753. As the screw 770 screws into bone, the head of the screw comes into contact with the inward protrusions of the shaft 752 (or the mating surfaces of the platform 754 in alternate embodiments). Continued application of torque on the screw 770 results in a compressive force being applied between the head of the screw and the pertinent portions of the shaft 752 (or platform 754). This results in the application of a downward force on the percutaneous vibration conductor 750 in general and the platform 754 in particular that drives the platform 754 downward towards the bone and/or any tissue between the bone and the platform. That said, in an alternate embodiment, the screw 770 is not used to apply downward force onto the percutaneous vibration conductor 750. Instead, the screw 770 is used to retain the percutaneous vibration conductor 750 in a "floating" or loose retention manner. That is, in an exemplary embodiment, the percutaneous vibration conductor 750 can move towards and away from the bone along the longitudinal axis of the screw 770 and/or can rotate about the longitudinal axis of the screw 770. It is further noted that in embodiments where the screw 770 is used to apply a compressive force onto the percutaneous vibration conductor 750, in some embodiments, the percutaneous vibration conductor 750 can still rotate about the longitudinal axis of the screw 770.

In an exemplary embodiment of the percutaneous vibration conductor 750 of FIG. 7, the bone penetrating component (e.g. screw 770) provides for a firm connection/anchorage to the bone that can be utilitarian in that it can provide improved transfer of vibrations from the percutaneous vibration conductor to the recipient relative to that which would be the case in the absence of the bone penetrating component. Alternatively and/or in addition to this, in at least some embodiments, this can reduce the likelihood of skin infections relative to that which would be the case in the absence of the bone penetrating component.

It is further noted that the embodiment of FIG. 7 can be utilized in the scenario represented by FIG. 6B above. This can be the case in scenarios where the percutaneous vibration conductor is configured to move in the aforementioned longitudinal directions and/or rotate in the aforementioned lateral directions.

It is noted that the bone penetrating component can be of a wide variety of configurations (e.g. geometries, material, etc.). As noted above, because the percutaneous vibration conductors do not need to carry the weight of the external component (e.g. BTE device) of the bone conduction device, the bone penetrating component can be relatively diminutive in size and/or strength relative to traditional bone fixtures utilized in bone conduction devices. By way of example only and not by way of limitation, the bone penetrating components according to at least some embodiments can have a maximum diameter of between about 1 to about 2.5 mm and/or can have a length of bone penetration of between about 1 mm to about 5 mm. In some exemplary embodiments, the bone penetrating components can be made of a material that osseointegrates with the bone and/or is treated with an antimicrobial/antibacterial coating as detailed herein with respect to other components of the percutaneous vibration conductor. In an exemplary embodiment, the screw 770 can include any of the features detailed herein and/or variations thereof that enhance osseointegration.

Figure 8:
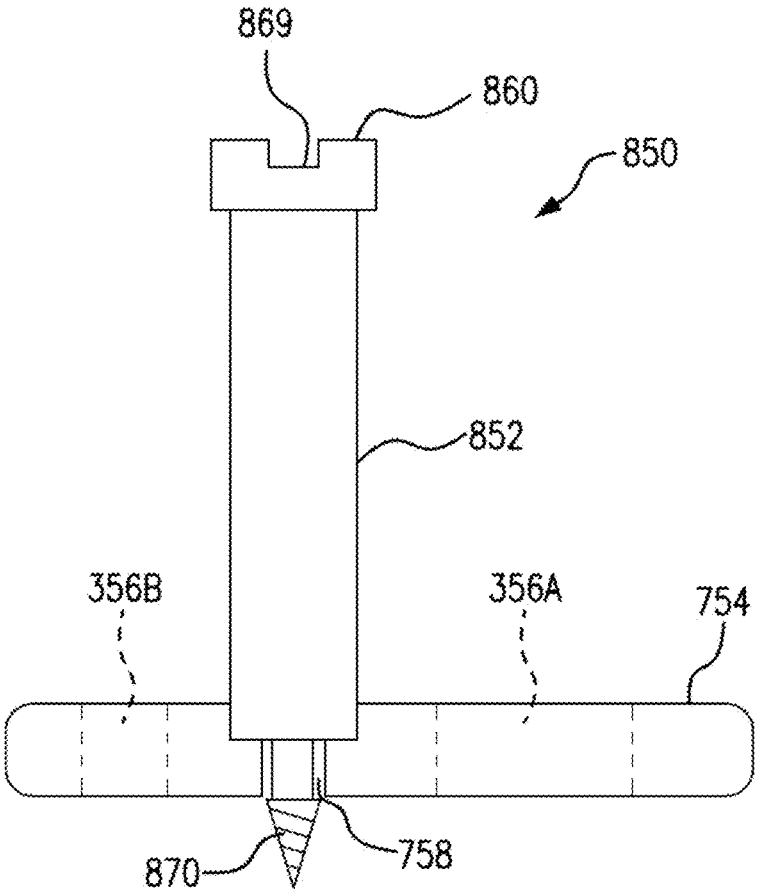

FIG. 8 depicts yet another alternate embodiment of a percutaneous vibration conductor 850 corresponding to the percutaneous vibration conductor 150 of FIG. 1, having a bone penetrating component. Percutaneous vibration conductor 850 parallels conductor 750, except that the shaft 852 includes a screw 870 integral therewith. The platform 754 of the embodiment of FIG. 8 is the same as the platform of the embodiment of FIG. 7, although in alternate embodiments, this is not the case.

In an exemplary embodiment utilizing the percutaneous vibration conductor 850, the platform 754 is first inserted into a recipient through a puncture through the skin of the recipient, and positioned on the bone and/or above the bone of the recipient. Then, shaft 852 is inserted through the puncture and the screw 870 is guided through bore 758 in platform 754. Alternatively, in an alternate embodiment, the combination of the platform 754 and the shaft 852 are inserted through the puncture. Shaft 852 can be rotated such that screw 870 screws into bone. Rotation can be achieved by applying a torque to the top abutment portion 860 that includes a component 869 configured to receive a screwdriver and/or the head of a wrench etc., such that torque can be applied to the shaft 852. Alternatively, in embodiments where the bone penetrating component is a spike or the like, downward pressure can be applied onto the shaft 852 to drive the spike into the bone.

The shaft 852 is driven into the bone of the recipient until the shaft is at a location that has utilitarian value with respect to maintaining a position between the percutaneous vibration conductor and the bone of the recipient. In this regard, the shaft 852 can be driven into the bone of the recipient such that the end surface of the shaft 852 that abuts the mating portion of the platform 754 and applies a downward force onto the platform 754. This force can be varied such that the resulting clamping force between the platform 754 and the bone of the recipient and/or soft tissue of the recipient prevents the platform 754 from rotating about the longitudinal axis of the shaft 852. Alternatively, this force can be varied such that the resulting clamping force enables the platform 754 to rotate about the shaft 852.

It is noted that while the embodiments of FIGS. 7 and 8 are depicted such that the screw 870 has clearance through the through bore 758, and thus can be completely retracted through the through bore 758, in alternative embodiments, configurations can exist such that the screw 870 is retained within the pertinent structure of the platform 754. In some such exemplary embodiments, this can have utility in that this decreases the likelihood of a loose part scenario. In some exemplary embodiments, the percutaneous vibration conductors are configured such that the screw 870 can be completely and/or partially retracted into the bore 758 such that the tip of the screw does not extend as far from the bottom surface of the platform 754 as might otherwise be the case and/or is entirely withdrawn into the confines of the platform 754.

In some exemplary insertion methods of inserting the percutaneous vibration conductors of the embodiments of FIGS. 7 and 8, the percutaneous vibration conductors 750 and 850 can be inserted into the recipient while the screws are protruding through the bottom surface of the platform 754, at least in part.

Figure 9:
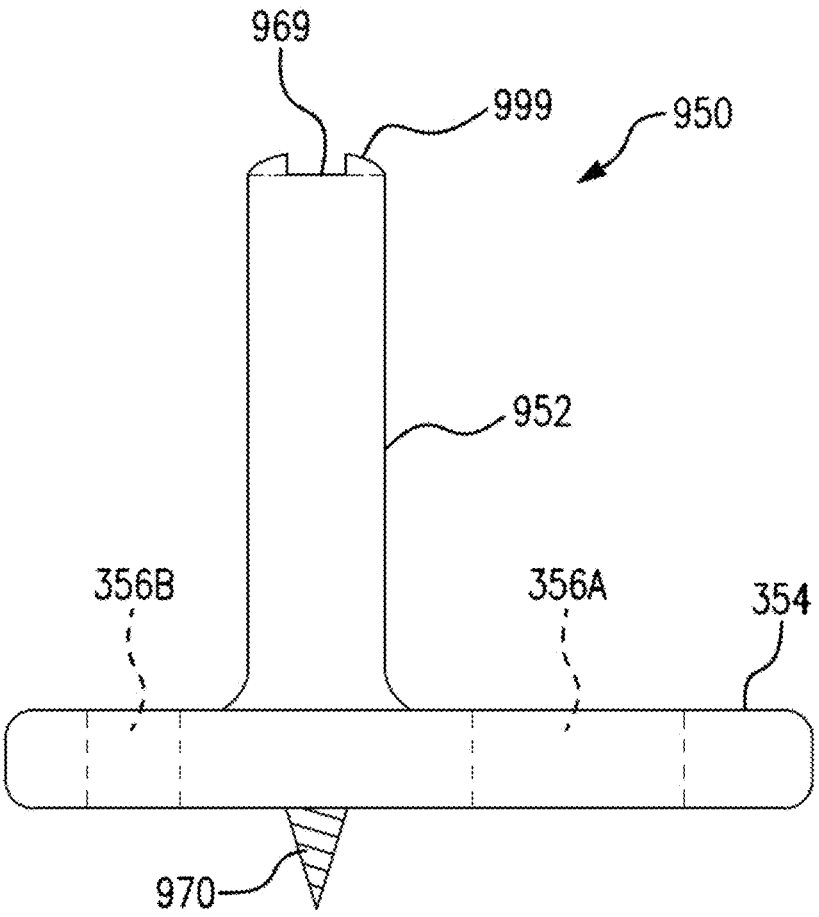

In a similar vein, FIG. 9 depicts an alternate embodiment of a percutaneous vibration conductor 950 that includes a bone penetrating component in the form of a screw 970 that is rotationally fixed to the platform 354. According to the embodiment of FIG. 9, screw 970 is integrally attached to the platform 354, such that rotation of the platform 354 corresponds to the same angular rotation of the screw 970. In this regard, in some exemplary embodiments, percutaneous vibration conductor 950 is inserted into the recipient through the puncture through the skin and positioned such that the tip of the screw 970 is located against bone of the recipient. In scenarios where there is sufficient room underneath the skin between the skin and the bone and/or between skin and underlying soft tissue, the entire percutaneous vibration conductor 950 is rotated and this rotation is transferred in a one-to-one relationship to the screw 970, thus screwing the screw 970 into the bone. Torque can be applied to the percutaneous vibration conductor 950 via component 969 located at the end of the shaft 952. Component 969 can be configured to receive a screwdriver and/or a wrench and/or any device that can enable a torque to be applied to the percutaneous vibration conductor 950 that can enable implantation of the conductor 950 via the screw 970 screwing to bone. It is noted that the surface 999 of the percutaneous vibration conductor 950 is still configured to abut the vibration transfer surfaces of the BTE device (or other surfaces of the other removable component of the appropriate bone conduction device) even though component 969 is located at the end of the shaft 952. That is, component 969 does not interfere with the performance of the percutaneous vibration conductor 950. That said in an alternate embodiment, the component 969 can be subsequently filled with a material (e.g. solder, a plug, etc.) to smooth out the surface 999.

Figure 10:
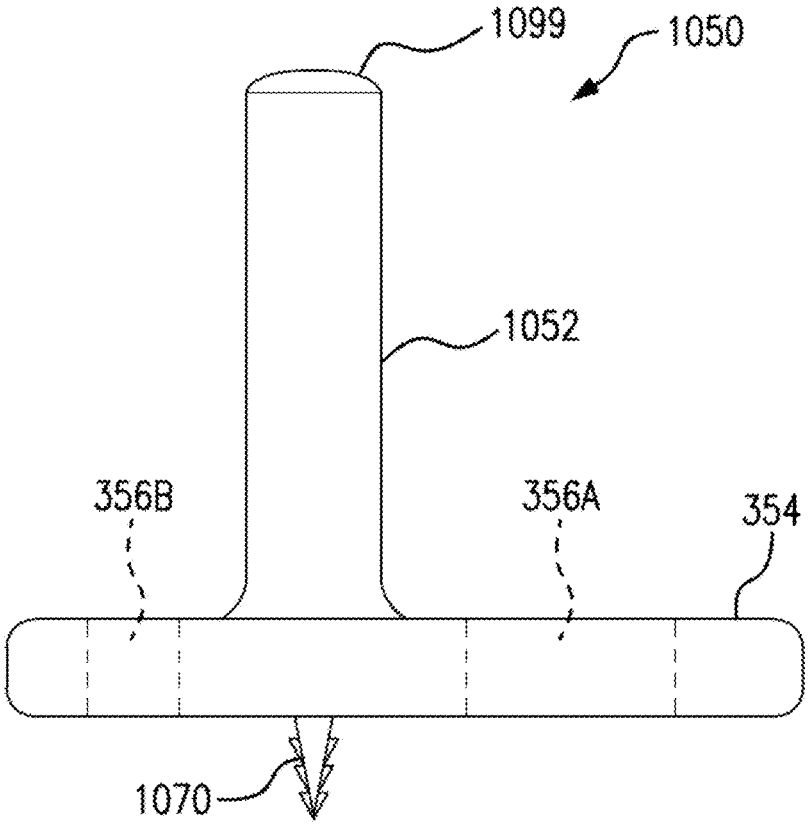

FIG. 10 depicts an alternate embodiment of a bone penetrating component 1070 attached to the platform 354 of the exemplary percutaneous vibration conductor 1050 depicted in FIG. 10. Bone penetrating component 1070 is in the form of a barbed spike. It is noted that in some embodiments, the barbs may not be present (i.e. only a spike is present). In an exemplary embodiment, the percutaneous vibration conductor 1050 is inserted into the recipient through a puncture and then the platform is positioned such that the tip of the spike 1070 contacts the bone. Then a force is applied to surface 1099 of shaft 1052, driving the spike 1070 into the bone of the recipient.

Alternative embodiments can utilize one or more arms located on the bottom surface of the platform 354.

The embodiments of FIGS. 7 through 10 are presented as having only one discrete bone penetrating component. It is noted that in alternative embodiments, exemplary vibration conductors can have two or more discrete bone penetrating components. Furthermore, combinations of different bone penetrating components can be utilized on the same percutaneous vibration conductor. Additionally, other types of bone penetrating components can be utilized (e.g. curved hooks). It is further noted that the positioning of the various bone penetrating components can be located at other locations beyond that which is depicted in the figures. By way of example only and not by way of limitation, screws can be located at other locations along the length of the platform 354. Furthermore, access to these bone penetrating components to drive the bone penetrating components into the bone can be achieved in different manners different from those detailed in the figures and/or described above. By way of example only and not by way of limitation, in an exemplary embodiment, the percutaneous vibration conductor according to FIG. 4 includes a screw located between the shaft 452 and hole 356A. The screw is driven into the bone utilizing a screwdriver or a wrench inserted through the puncture through the skin in a manner generally parallel to the longitudinal axis of the shaft 452. Any device, system and/or method that can enable a bone penetrating component to maintain a position between the percutaneous vibration conductor and the bone of the recipient can be utilized in at least some embodiments.

Figure 11:
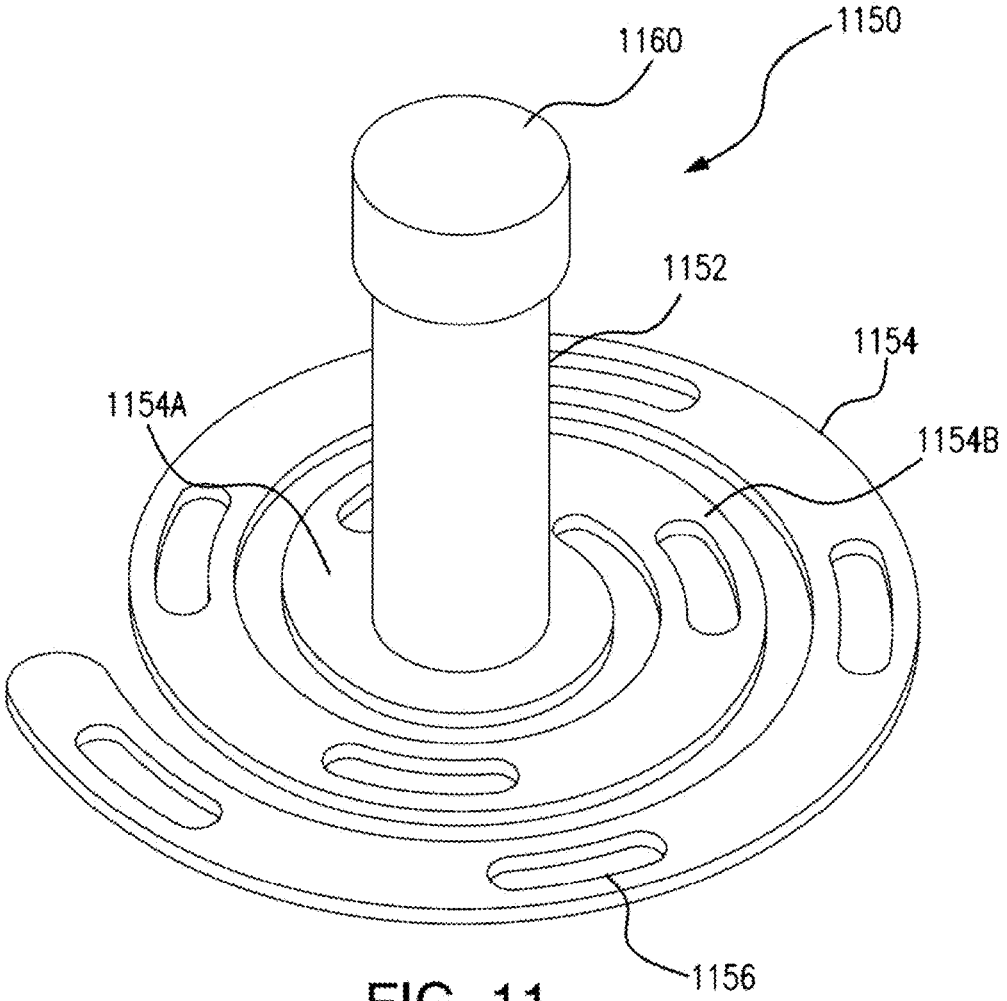

FIG. 11 depicts yet another embodiment of a percutaneous vibration conductor 1150 corresponding to conductor 150 FIG. 1. The percutaneous vibration conductor 1150 of FIG. 11 includes a spiral shaped platform 1154. More particularly, conductor 1150 includes a shaft 1152 and a cap 1160 according to the teachings above. It is noted that in alternative embodiments, different types of shafts and or caps can be utilized. Indeed in some embodiments, no caps are utilized. By way of example only and not by way of limitation, in an exemplary embodiment, shaft 1152 can correspond to shaft 352 detailed above. It is further noted that in some embodiments, vibration conductor 1150 can include some of the other features as detailed herein, such as for example the bone penetrating components etc.

As can be seen from FIG. 11, the spiral platform 1154 includes a base portion 1154A that extends about at least a portion of the outer circumference of the shaft 1152. Arm 1154B extends away from the base platform 1154A and spirals around the base platform (and thus the shaft 1152). In the embodiment depicted in FIG. 11, the arm spirals about the platform and shaft about 1 and a half times. In alternate embodiments, the arm can spiral more than this (e.g. about 2, about 2 and a half, about 3, about three and a half or more times). In alternate embodiments, the arm can spiral less than that depicted in FIG. 11 (e.g. about once, about three-quarters, a half, etc.). Further, the arm can have a uniform configuration as it spirals about the platform 1154A and/or the shaft 1152, as generally depicted in FIG. 11. Alternatively, the arm can having a nonuniform configuration as it spirals. By way of example only and not by way of limitation, the radial thickness of the arm can vary as it spirals about the platform (e.g. increasing with spiral distance from the platform, decreasing with spiral distance from the platform, varying an increase and a decrease with spiral distance from the platform. Alternatively and/or in addition to this, the axial thickness of the arms can vary in a like manner.

As can be seen, FIG. 11 includes through holes 1156 through the spiral arm of the platform 1154.

It is noted that in alternate embodiments, a platform 1154A may not be present. That is, in at least some exemplary embodiments, the spiral arms spirals directly from the side of the shaft 1152.

Any arrangement of spiraling that can enable the teachings detailed herein and or variations thereof to be practiced can utilize in at least some embodiments.

In an exemplary embodiment, the percutaneous vibration conductor 1150 is inserted into the recipient by first inserting the tip of the spiral arm into the puncture through the skin such that the tip is positioned between the skin and bone and/or soft tissue of the recipient. The percutaneous vibration conductor 1150 is then rotated such that the spiral arm 1154B snakes through the puncture through the skin of the recipient and underneath the skin between the skin and the bone and/or soft tissue. This rotating is continued on until the entire platform 1154 is seated against the bone and/or soft tissue as applicable.

In an exemplary embodiment, the spiral platform of FIG. 11 can have utilitarian value in that it can offer stabilization of the percutaneous vibration conductor 1150 in more than one or two directions relative to the normal direction of the longitudinal axis of the conductor. Indeed in the embodiment of FIG. 11, stabilization of the conductor 1150 is offered in all directions about the longitudinal axis thereof.

Figure 12:
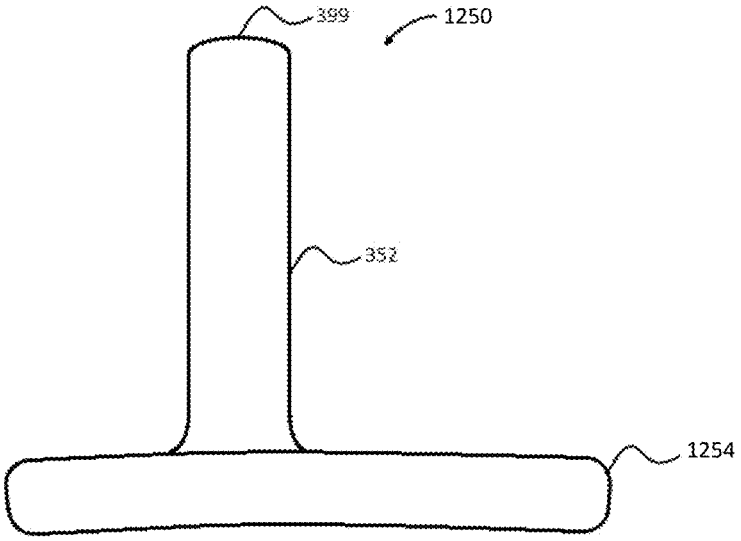

FIG. 12 depicts yet another alternate embodiment of an exemplary percutaneous vibration conductor 1250 corresponding to conductor 150 of FIG. 1, where the platform 1254 has a slight curvature. As can be seen, the bottom surface of the platform 1254 (i.e. the side that faces the bone when the conductor 1250 is placed into the recipient) is concave shaped relative to location of the bone (convex shape relative to the location of the shaft 352). While the embodiment of FIG. 12 also depicts a top surface of the platform 1254 that is curved in a concave manner relative to the location of the bone (convex shape relative to the location of the shaft 352), it is noted that in alternate embodiments, the top surface of the platform 1254 can have a different shape (e.g. it could be flat, it could be convex relative location of the bone etc.).

In at least some exemplary embodiments, the curvature of at least a bottom surface the platform 1254 can have utilitarian value because the curvature can accommodate the curvature of the bony ridge of the mastoid and/or because the curvature can accommodate the general curvature of the skull. In embodiments where the curvatures are utilized in combination with a bone penetrating component (e.g. the screws detailed herein), when the percutaneous vibration conductor 1250 is pressed downward such that the bone penetrating component penetrates into the bone, the reaction force of the bone (or soft tissue) against the platform 1254 forces the platform to adopt a different configuration (more straightened, including straightened configuration, etc.). In an exemplary embodiment, the reaction force can force the platform 1254 to adopt a shape that better conforms to the surface of the bone relative to that which would be the case in the absence of the curved configuration. That is, owing to the relatively compliant nature of the platform 1254, the platform better adopts the shape of the local bone structure. This can have utilitarian value in that the resulting shape results in more contact with the pertinent tissue (bone) relative to that which would be the case without this feature. Alternatively and/or in addition to this, this can have utilitarian value in that the resulting shape results in a more uniform distance from the bone than that which would be the case in the absence of this feature and/or results in a configuration such that, on average, individual locations on the bottom surface of the platform 1254 are closer to the bone than that which would be the case in the absence of this feature.

It is noted that the various embodiments herein are presented for purposes of textual and or pictorial economy. Simply because one embodiment does not include a feature of another embodiment does not mean that one embodiment excludes the other feature. In this regard, it is noted that in at least some embodiments, any feature of any embodiment detailed herein can be combined with any feature of any other embodiment detailed herein unless otherwise specifically noted.

Embodiments of the percutaneous vibration conductors detailed herein and are variations thereof can be made out of various types of metals (for example, stainless steel, titanium, etc.). Alternatively, in at least some embodiments, at least some portions of the percutaneous vibration conductors detailed herein and or variations thereof can be made of biocompatible polymers such as by way of example only and not by way of limitation, PEEK (polyetheretherketone). Any material that can enable the teachings detailed herein and or variations thereof to be practiced can utilize in at least some embodiments.

Accordingly, in an exemplary embodiment, there is a percutaneous vibration conductor according to an exemplary embodiment that has a weight of about 0.05 grams to about 0.5 grams or any value or range of values therebetween in about 0.01 gram increments. In an exemplary embodiment, this can correspond to a conductor made substantially entirely of titanium. In an exemplary embodiment, this can correspond to a conductor made substantially entirely of titanium and permanent magnet material.

Further along these lines, in at least some embodiments, at least a portion of the percutaneous vibration conductors detailed herein and or variations thereof (e.g. the platforms)

can be made from a shape memory alloy (e.g., Nitinol) or a shape memory polymer (e.g., polyurethanes). An exemplary embodiment, such configurations can have utility in that they enable a wider range of implantation procedures can be executed beyond that which would be the case in the absence of the utilization of such materials. For example, a situation where the platforms are made of a shape memory alloy can enable the percutaneous vibration conductors to be placed to a puncture having a smaller maximum diameter than that which might be the case in implantation scenarios where the platforms are made out of a rigid material. Alternatively and/or in addition to this, the shape memory alloy can enable improved contouring features relative to the outer surface of the bone (e.g., a can the features achieved by utilizing the embodiment of FIG. 12 detailed above).

Still further by example, the platform can be made of an expandable material that expands after implantation into the recipient. For example, with reference to FIG. 11, the platform can initially be wound tighter such that the overall maximum outer diameter is initially smaller. This would facilitate insertion into the recipient. After implantation, the spiral loosens such that the overall maximum outer diameter is larger. Thus, increased stability can be achieved for given size hole relative to that which would be the case in the absence of an expanding platform.

In an exemplary embodiment, a temperature change can cause the expansion. For example, the platform can be cooled to a first temperature that causes the platform to contract, and then, after implantation, as the platform warms to body temperature, the platform expands. Alternatively or in addition to this, an electric charge can be applied to the platform to expand the platform (i.e., the platform can be made of a material that expands upon the application of a sufficient electrical current, and, in some embodiments, one that maintains the expansion after the current is removed). It is noted that the reverse can also be the case—the platform can be made of a material that contracts under certain phenomenon to facilitate removal of the conductor.

In an exemplary embodiment, at least the platform, or at least a portion of the platform, is made of nitinol/NiTi.

Any device, system or method that can enable the platform to expand and/or to contract after insertion and/or prior to removal, respectively, can be utilized in at least some embodiments.

Some exemplary methods of implanting the skin penetrating components (e.g., percutaneous vibration conductors) detailed herein and/or variations thereof will now be described with reference to FIGS. 13A to 14B.

Figure 13A:
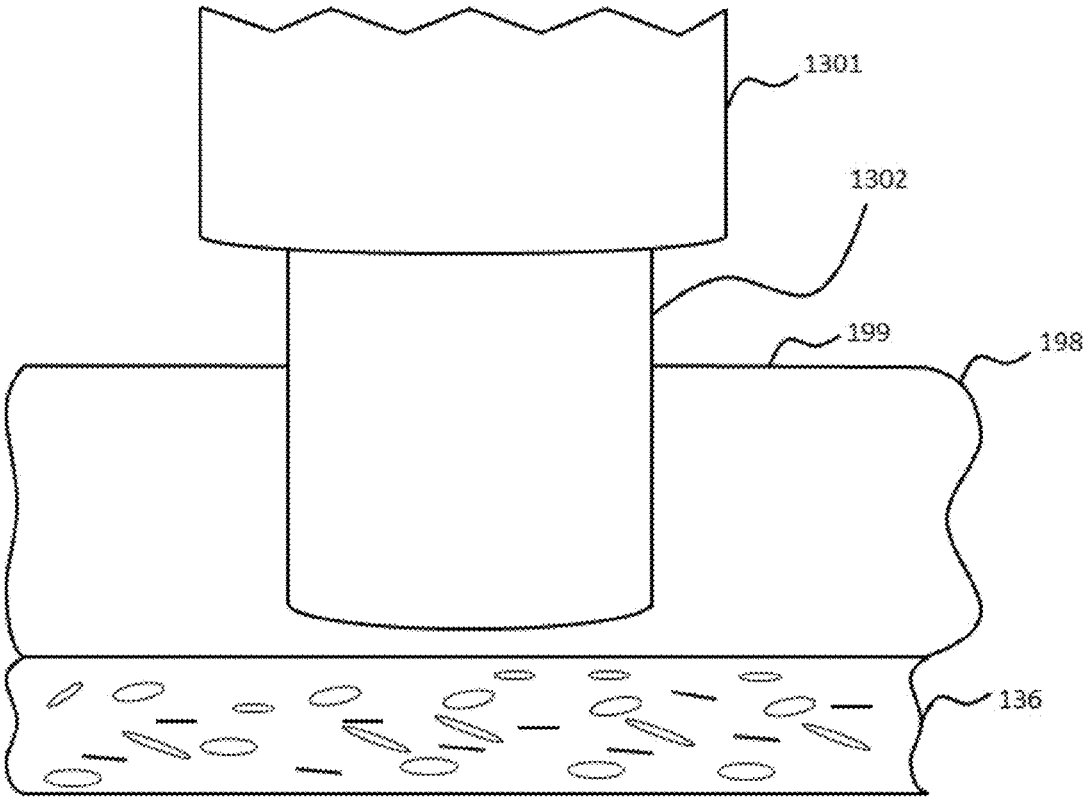
FIGS. 13A-13E present pictorials of exemplary method actions according to an exemplary embodiment.
Figure 13B:
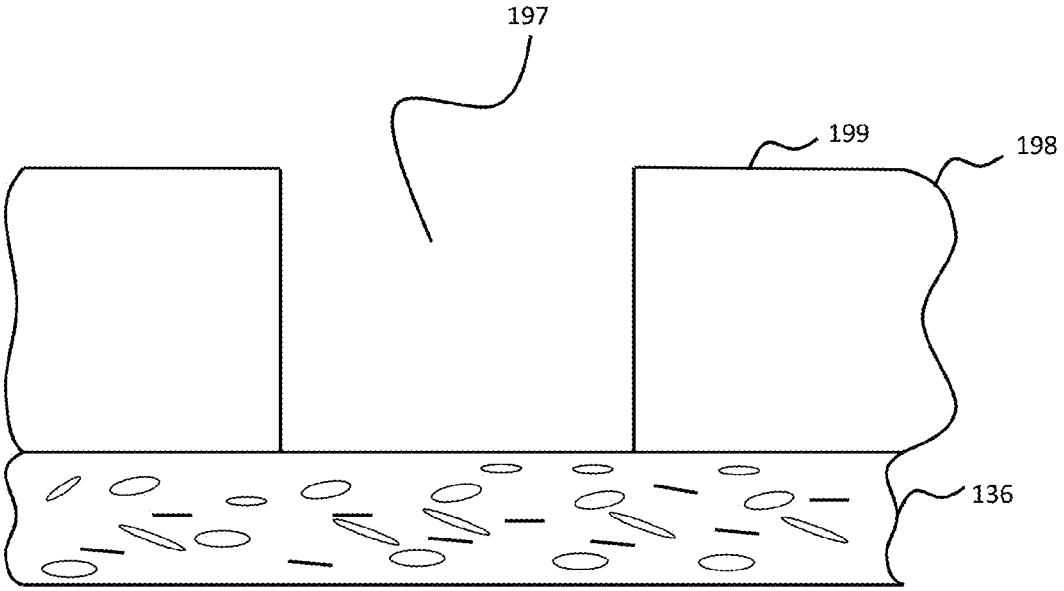
Figure 13C:
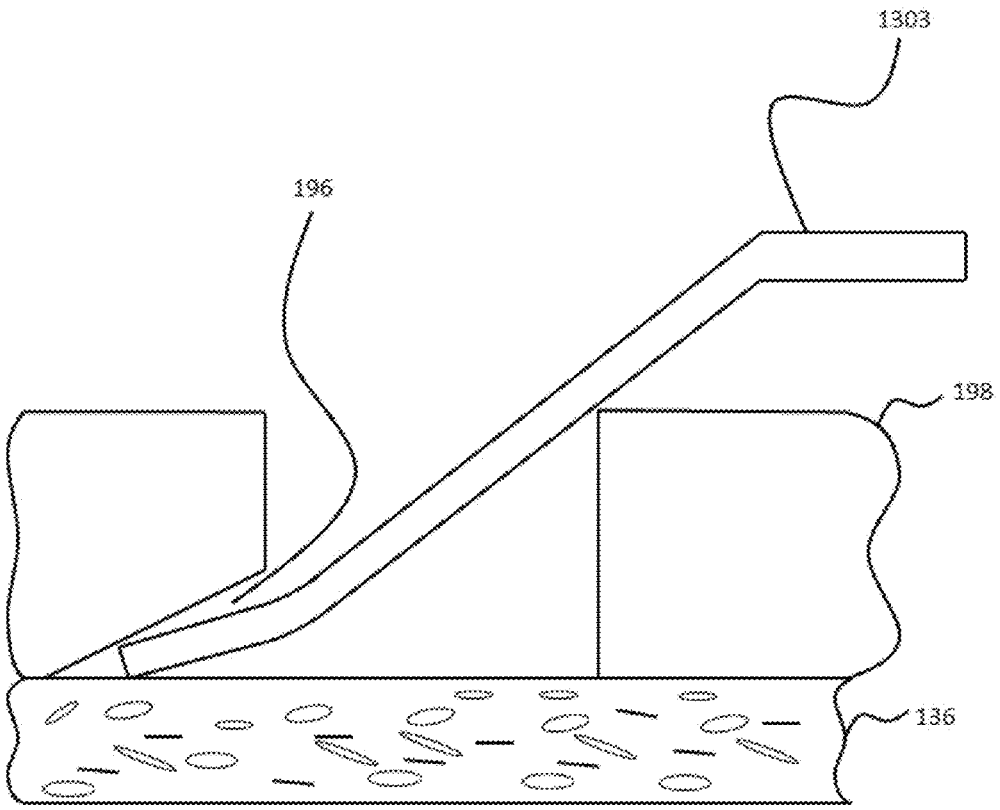
Figure 13D:
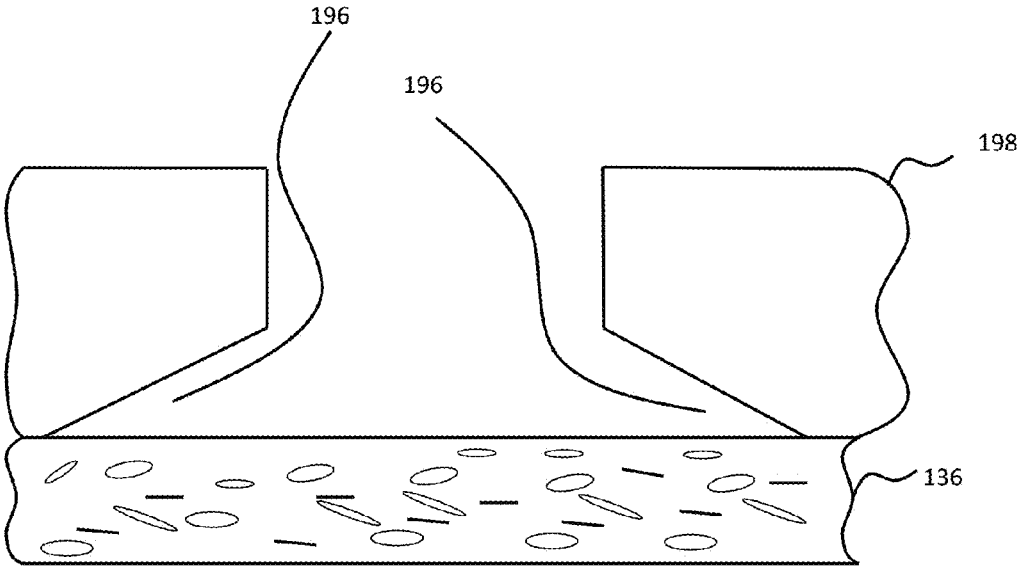
Figure 13E:
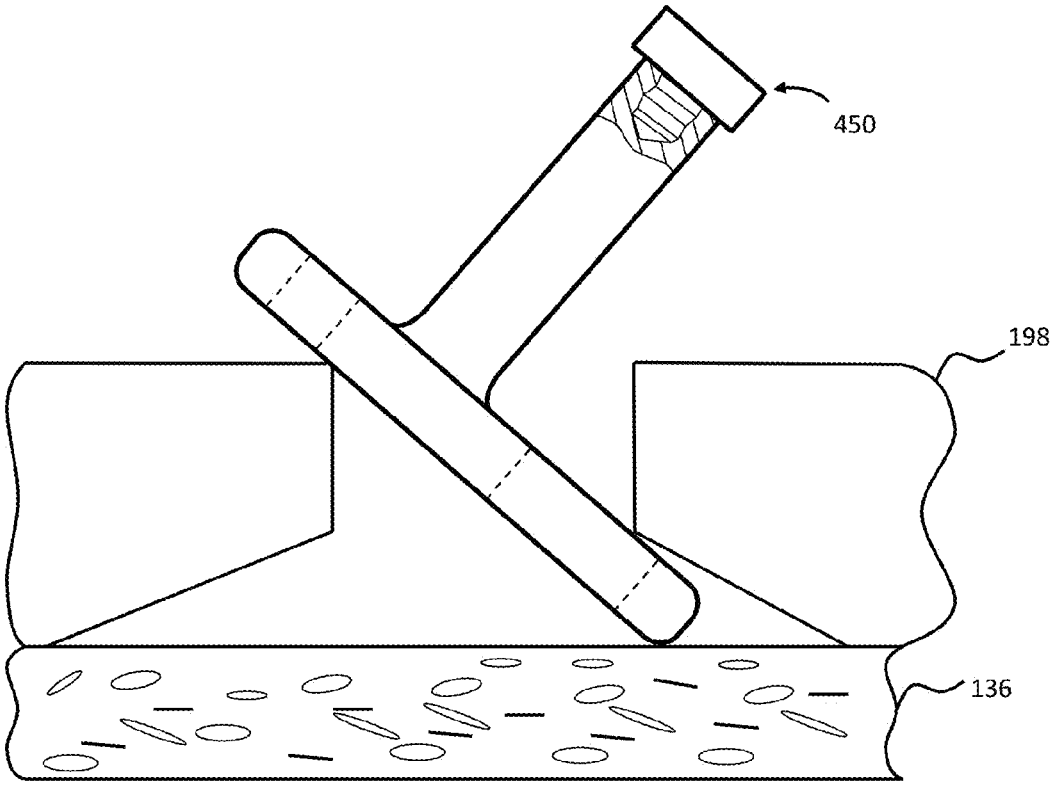
Figure 14A:
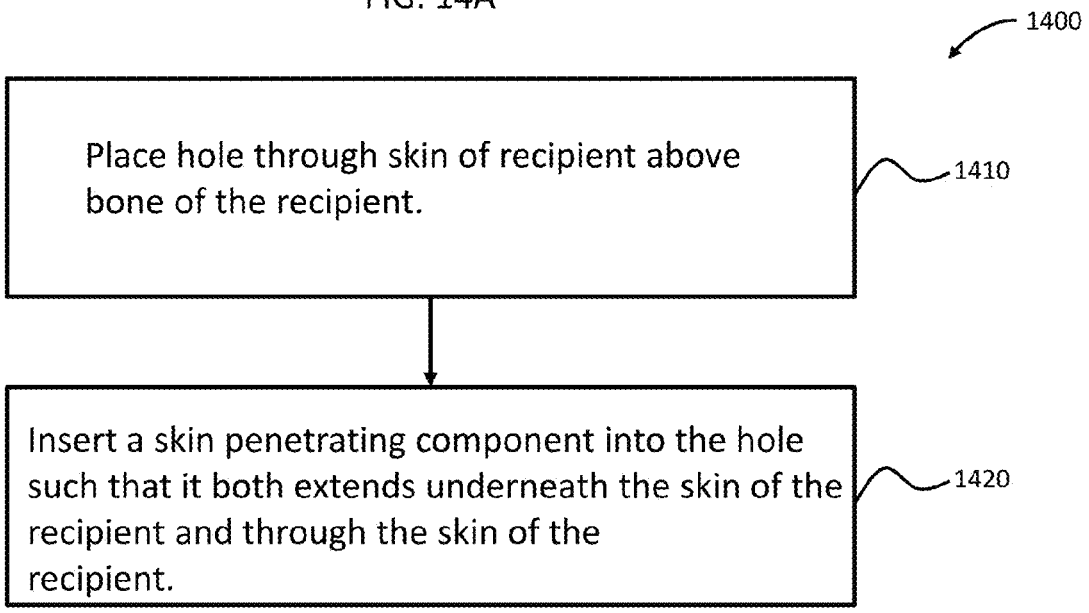
FIGS. 14A and 14B present exemplary flowcharts according to exemplary methods of some exemplary embodiments.
Figure 14B:
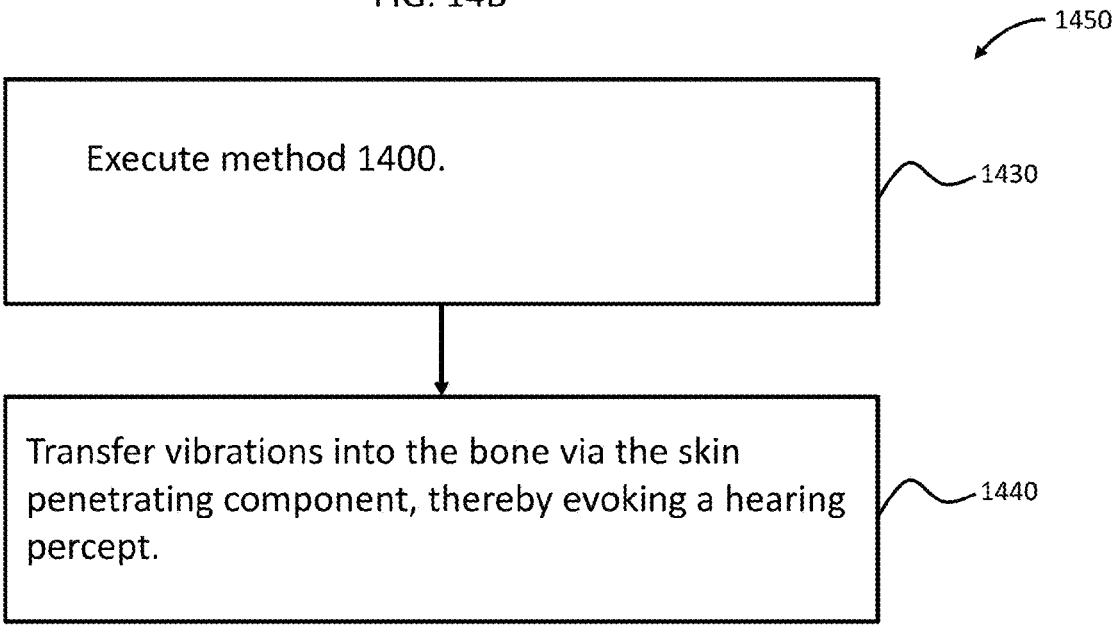

FIGS. 13A-13E pictorially depict method actions of a method of implanting the skin penetrating components of at least some embodiments. FIGS. 14A and 14B present flow charts of some of these method actions.

More specifically, referring to FIG. 14A, in an exemplary embodiment, there is a method 1400 that includes a method action 1410 that entails placing a hole through the skin of the recipient of the bone of the recipient. In an exemplary embodiment, method action 1410 can be accomplished, with reference to FIG. 13A, utilizing punch 1301 having a hollow cylinder 1302 with sharp leading edges. In the embodiment depicted in FIG. 13A, the punch 1301 is driven through the skin of the recipient (optionally, with a circular cutting motion about the longitudinal axis the punch 1301) such that the hollow cylinder 1302 penetrates through the surface 199 of soft tissue 198 and "punches out" a cylindrical section of soft tissue 198 extending from surface 199 to the surface of the bone 136 facing the soft tissue. The result is depicted in FIG. 13B, where puncture 197 through soft tissue 198 results from utilization of the punch 1301. Accordingly, FIGS. 13A and 13B depict method action 1410.

Method 1400 includes method action 1420, which entails inserting a skin penetrating component (e.g., one of the percutaneous vibration conductors detailed herein and/or variations thereof) into the hole 197 (puncture 197) resulting from the execution of method action 1410 such that at least a portion of the skin penetrating component extends underneath the skin of the recipient and through the skin of the recipient. FIG. 13E depicts execution of method action 1420 (some additional features of FIG. 13E will be described further below). Any of FIGS. 6A to 6D depict the result of method action 1420. It is noted that in an exemplary embodiment of method action 1420, the extension underneath the skin of the recipient is substantial. In an exemplary embodiment, the distance of extension underneath the skin from the longitudinal axis of the percutaneous vibration conductor and/or from a side wall of the percutaneous vibration conductors shaft is about equal to and/or greater than the distance from the bone to the top surface of the skin local to the location where the percutaneous vibration conductor is inserted into the hole.

FIG. 14B depicts another exemplary method 1450 according to an exemplary embodiment. Method 1450 includes method actions 1430 and 1440. Method action 1430 entails executing method 1400 as just described above. Method action 1440 includes transferring vibrations into the bone via the skin penetrating component, thereby evoking a hearing percept. Along these lines, FIG. 1 depicts an arrangement where this latter method action can be executed.

It is noted that method 1400 can include additional action beyond those just detailed. By way of example only and not by way of limitation, method 1400 can include the action of lifting skin away from the bone that lies over the bone. FIG. 13C pictorially depicts execution of this additional method action. More specifically, skin lifting tool 1303 can be seen inserted into the hole 197 so as to lift the skin (indeed as well as all of the soft tissue 198) away from the bone 136, thereby creating a gap 196 between the skin (and substantially all of the soft tissue 198) and the bone 136. In an exemplary embodiment this gap can be considered an air gap in that the left tissues are no longer connected to the tissue from which those tissues were lifted (e.g. the soft tissue 198 is no longer connected to bone 136. In an exemplary embodiment, the skin lifting tool 1303 utilized to create a 196 around the entire circumference of the hole 197. FIG. 13D depicts this exemplary embodiment, although it is noted that this is an ideal scenario, as separation of soft tissue 198 from the bone 136 may not be as clean as depicted (i.e., some soft tissue may still be present on the bone 136. It is noted that embodiments detailed herein and/or variations thereof can be used with less than ideal separation of soft tissue from bone.

According to at least some embodiments, method 1400 includes the additional action of extending a portion of the skin penetrating component (e.g. the platform of the percutaneous vibration conductor) between the lifted skin (or the lifted soft tissue) and the bone. Along these lines, FIG. 13E depicts such an exemplary action.

As noted above, at least some exemplary embodiments of the percutaneous vibration conductors detailed herein have a profile that is between a "T" shape and an "L" shape. Accordingly, in an exemplary embodiments, method 1400 includes extending a first portion of the skin penetrating component (e.g. the end of the platform furthest away from the shaft of the percutaneous vibration conductors detailed herein) between the skin and the bone. FIG. 13E depicts such an exemplary action. This method action is then followed by the action of extending a second portion of the skin penetrating component (e.g. the end of the platform closest to the shaft of the percutaneous vibration conductors detailed herein) between the skin and the bone. According to at least some exemplary method actions, the first portion of the skin penetrating component is extended between the skin (soft tissue) and the bone by movement of the skin penetrating component in a first direction, and the second portion of the skin penetrating component is extended between the skin (soft tissue) and the bone by movement of the skin penetrating component and a second direction opposite the first direction.

That said, in at least some embodiments, such as by way of example only and not by way of limitation embodiments utilizing the spiral arm of the embodiment of FIG. 11, the first portion of the skin penetrating component is extended between the skin and the bone by a first rotation of the skin penetrating component and a first direction (e.g., by way of example only and not by way of limitation with respect to the embodiment of FIG. 11, clockwise rotation of the percutaneous vibration conductor 1150 relative to the view depicted in FIG. 11). Still further, in at least some embodiments, the second portion is extended between the skin and the bone by continued rotation of the skin penetrating component in that first direction. Accordingly, along these lines, with respect to the embodiment of FIG. 11, a first portion can include a part of the arm 1154B located at the end of the arm (e.g. a part that encompasses the first two holes through the platform 1154 relative to the tip of the arm 1154B), and a second portion can include a part of the arm 1154B located further away from the tip (e.g. part of the arm that compresses the third and fourth holes through the platform 1154 relative to the tip of the arm 1154B).

Is further noted that some exemplary embodiments include two or more skin penetrating components that are in contact with the same external device. By way of example only and not by way of limitation, in an exemplary embodiment, two or more percutaneous vibration conductors as detailed herein and or variations thereof extend through the skin of the recipient as detailed herein. However, two or more of the conductors are in contact with the same BTE device and/or located such that one is in contact with the BTE device in a scenario that the other one is not in contact with the BTE device. In an exemplary embodiment, this can have utility in the event that the recipient moves or otherwise is subjected to force is the result of movement of the BTE device. Still further it is noted that the heights above the skin of the respective percutaneous vibration conductors can be different. By way of example only and not by way of limitation, one of the percutaneous vibration conductors can extend to a height of about 1 mm to about 2 mm above the surface of the skin, and another of the percutaneous vibration conductors can extend to a height of about 1.5 millimeters to about 2.5 millimeters above the surface of the skin.

While various embodiments of the present invention have been described above, it should be understood that they have been presented by way of example only, and not limitation. It will be apparent to persons skilled in the relevant art that various changes in form and detail can be made therein without departing from the spirit and scope of the invention. For instance, in alternative embodiments, the BTE is combined with a bone conduction In-The-Ear device. Thus, the breadth and scope of the present invention should not be limited by any of the above-described exemplary embodiments, but should be defined only in accordance with the following claims and their equivalents.

What is claimed is:

1. A device, comprising:

a bone conduction prosthesis including an external component configured to output a signal in response to an external stimulus and a skin penetrating component configured to communicatively transfer the signal at least partially beneath skin of a recipient, wherein the skin penetrating component is configured to extend into skin of the recipient and substantially entirely lay above a surface of bone of a recipient in abutting contact thereto.

2. The device of claim 1, wherein:

the skin penetrating component is configured to move relative to surface of the bone when the device is utilized on the recipient to stimulate tissue of the recipient during use of the device.

3. The device of claim 1, wherein:

the skin penetrating component is configured to surface mount on the bone.

4. The device of claim 3, wherein:

the skin penetrating component is configured to be the only component beneath a surface of skin of the recipient when the device is utilized on the recipient.

5. The device of claim 1, wherein:

the skin penetrating component includes a platform extending in a lateral direction, which platform corresponds to the portion of the component that substantially entirely lays above the surface of bone of the recipient in abutting contact thereto.

6. The device of claim 1, wherein the skin penetrating component includes a platform extending in a first lateral direction, a length of extension in the first lateral direction being substantially greater than that in a second lateral direction normal to the first lateral direction, wherein the platform is configured to resist movement in a direction below a surface of the bone, and wherein the platform has a solid bottom surface that extends contiguously from a first tip in the first lateral direction to a second tip in the second lateral direction.

7. The device of claim 6, wherein:

the skin penetrating component includes a skin penetrating shaft, wherein an outer diameter of the shaft lying on a plane normal to a direction of skin penetration is less than about half that of the platform also lying on a plane normal to the direction of skin penetration.

8. The device of claim 6, wherein:

an outer profile of the skin penetrating component is at least one of "L" shaped, inverted "T" shaped, or between an "L" shape and an inverted "T" shape.

9. The device of claim 1, wherein the skin penetrating component includes a laterally extending component configured to extend underneath skin of the recipient and a longitudinally extending component configured to extend through the skin of the recipient, wherein the laterally extending component extends a distance more than about half the height of the skin penetrating component in a direction at least approximately normal to the direction of extension of the longitudinally extending component in abutting contact to the surface of bone of the recipient, wherein a portion of the laterally extending component extending underneath the skin has a maximum outer diameter lying on a plane parallel to the surface of the bone that is smaller than a maximum outer diameter of the longitudinally extending component.

10. The device of claim 1, wherein:

the skin penetrating component is configured to extend into skin of the recipient and lay completely above a surface of bone of a recipient in complete abutting contact thereto.

11. The device of claim 1, wherein:

the skin penetrating component is configured to be implanted in a recipient; and the skin penetrating component is configured to be at least one of not rigidly attached to bone of the recipient, not substantially penetrating below a local surface of bone of the recipient or not penetrating below a local surface of bone of the recipient.

12. The device of claim 1, wherein:

the skin penetrating component is configured to extend into skin of the recipient and lay completely above a surface of bone of a recipient in complete abutting contact thereto such that all parts of the device are above the surface of bone.

13. The device of claim 1, wherein:

the skin penetrating component encompasses all portions of the device configured to be beneath the skin of the recipient; and the skin penetrating component is configured such that it is free of bone anchoring when the device is used.

14. The device of claim 1, wherein:

the skin penetrating component encompasses all portions of the device configured to be beneath the skin of the recipient.

15. The device of claim 1, wherein:

there is no bone fixture as part of the device.

16. The device of claim 1, wherein:

the device is a totally above bone surface device.

17. The device of claim 1, wherein:

the device is a minimally bone intrusive device.

18. A device, comprising:

a bone conduction hearing prosthesis including an external component configured to output vibrations in response to a captured sound and a skin penetrating component abutting the external component configured to transfer the vibrations at least partially beneath the skin of a recipient, wherein the skin penetrating component is configured to be at least substantially supported by soft tissue.

19. The device of claim 18, wherein the skin penetrating component is configured to be positively retained in the recipient via the soft tissue.

20. The device of claim 18, wherein the skin penetrating component is configured to hook into soft tissue of the recipient.

21. The device of claim 18, wherein the skin penetrating component is non-rigidly coupled to the external component.

22. The device of claim 18, wherein the skin penetrating component is non-holdingly coupled to the external component.

23. The device of claim 18, wherein the skin penetrating component is magnetically coupled to the external component, and wherein the external component is articulable relative to the skin penetrating component while coupled to the external component.

24. The device of claim 18, wherein:

the skin penetrating component is configured to be the entirety of the portion of the device beneath a surface of skin when the device is used to evoke a hearing percept.

25. The device of claim 18, wherein the skin penetrating component is configured to be positively retained in the recipient via the soft tissue such that no reaction force from bone is utilized for the positive retention.

26. The device of claim 18, wherein the skin penetrating component is configured to be positively retained in the recipient via the soft tissue owing substantially entirely to a component that extends in a lateral direction on or just above a surface of bone of the recipient underneath the skin of the recipient.

27. A device, comprising:

a bone conduction hearing prosthesis including an external component configured to output vibrations in response to a captured sound and a skin penetrating component configured to abut the external component such that it is in vibrational communication with the external component, wherein the skin penetrating component is a skin anchored skin penetrating component.

28. The device of claim 27, wherein:

the skin penetrating component includes through holes configured for soft tissue to grow therethrough.

29. The device of claim 27, wherein:

the skin penetrating component includes an extender configured to extend a skin penetration distance thereof.

30. The device of claim 27, wherein:

the skin penetrating component includes a bone penetrating component configured to maintain a position between the skin penetrating component and bone of a recipient.

31. The device of claim 27, wherein:

the skin penetrating component includes a platform apparatus in the form of a beam extending away from a longitudinal axis of the skin penetrating component.

32. The device of claim 27, wherein:

the skin penetrating component includes a platform apparatus in the form of a spiral-shaped plate extending away from a longitudinal axis of the skin penetrating component in a spiral manner.

33. The device of claim 27, wherein:

the skin penetrating component includes a platform apparatus that has a concave surface on a side facing bone of a recipient of the skin penetrating component.

34. The device of claim 27, wherein:

the skin penetrating component includes a platform apparatus that is made of a shape memory material.

35. A device, comprising:

means for conducting vibrations generated externally to a recipient to a location beneath a surface of skin of the recipient, wherein the means for conducting vibrations includes means for anchoring the means for conducting vibrations in the recipient.

36. The device of claim 35, wherein:

the means for conducting vibrations falls entirely within a volume of 15 mm by 10 mm by 5 mm.

37. The device of claim 35, wherein:

the means for conducting vibrations weighs no more than about 0.15 grams.

38. The device of claim 35, wherein:

the means for conducting vibrations includes a portion configured to extend through soft tissue of the recipient having a maximum outer diameter of 4 mm at a location beneath a surface of skin of the recipient.

39. The device of claim 35, wherein:

the means for conducting vibrations is configured to effectively evoke a hearing percept when conducting vibrations generated by a vibrator that vibrates in response to captured sound.

* * * * *